US009316428B2

(12) United States Patent
Mech

(10) Patent No.: US 9,316,428 B2
(45) Date of Patent: Apr. 19, 2016

(54) COOLER WITH EMBEDDED MATRIX OF CLEATS AND ATTACHABLE ACCESSORIES

(71) Applicant: John R. Mech, Winnetka, IL (US)

(72) Inventor: John R. Mech, Winnetka, IL (US)

( * ) Notice: Subject to any disclaimer, the term of this patent is extended or adjusted under 35 U.S.C. 154(b) by 281 days.

(21) Appl. No.: 14/186,514

(22) Filed: Feb. 21, 2014

(65) Prior Publication Data

US 2015/0241107 A1 Aug. 27, 2015

(51) Int. Cl.
*F25D 3/08* (2006.01)

(52) U.S. Cl.
CPC ..... *F25D 3/08* (2013.01); *F25D 2400/38* (2013.01)

(58) Field of Classification Search
CPC ..... F25D 3/00; F25D 3/02; F25D 3/04; F25D 3/045; F25D 3/06; F25D 3/08
USPC ..... 220/592.01–592.05, 592.09, 592.1, 220/592.16, 592.2, 694, 729, 735–743, 220/751–759, 768, 767, 770–772
See application file for complete search history.

(56) References Cited

U.S. PATENT DOCUMENTS

| | | | | |
|---|---|---|---|---|
| 5,285,656 | A * | 2/1994 | Peters | 62/457.1 |
| 6,405,864 | B1 * | 6/2002 | Streich et al. | 206/373 |
| 7,121,407 | B2 * | 10/2006 | Hurt et al. | 206/373 |
| 7,389,608 | B1 * | 6/2008 | MacKay | 43/57 |
| 2005/0072712 | A1 * | 4/2005 | Strickland | 206/570 |
| 2009/0188819 | A1 * | 7/2009 | Carney et al. | 206/315.1 |
| 2013/0207360 | A1 * | 8/2013 | Vanderberg et al. | 280/30 |

* cited by examiner

*Primary Examiner* — Steven A. Reynolds
*Assistant Examiner* — Javier A Pagan
(74) *Attorney, Agent, or Firm* — Justin Lampel

(57) ABSTRACT

A cooler having an embedded matrix of cleats which substantially covers the internal and external surfaces of the cooler is provided. The cleats of the cooler correspondingly connect to and allow for the attachment of various articles, such as beverage holders, lid hinges, wheels, towing bar, leg attachments, handles, paper towel holders or seats, to be secured to the exterior or interior surface of the cooler. Dividers may be secured to the interior of the cooler so as to allow the compartmentalization of the interior cooler space. The cooler also has adjustable securing devices which allow a user to build his/her own securing attachment device to secure virtually any object to the cleats of the cooler.

16 Claims, 23 Drawing Sheets

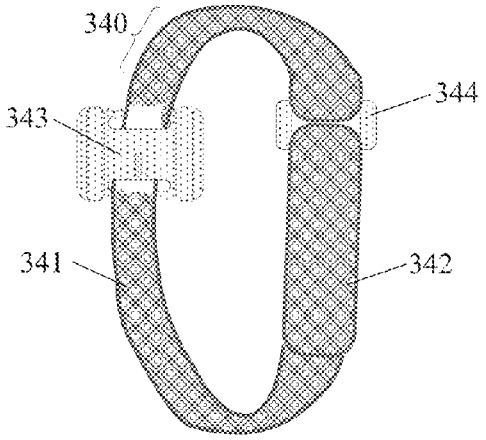
Fig. 42a
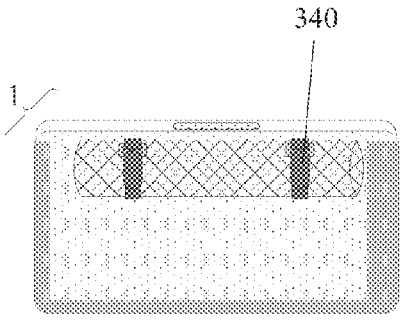
Fig. 42b
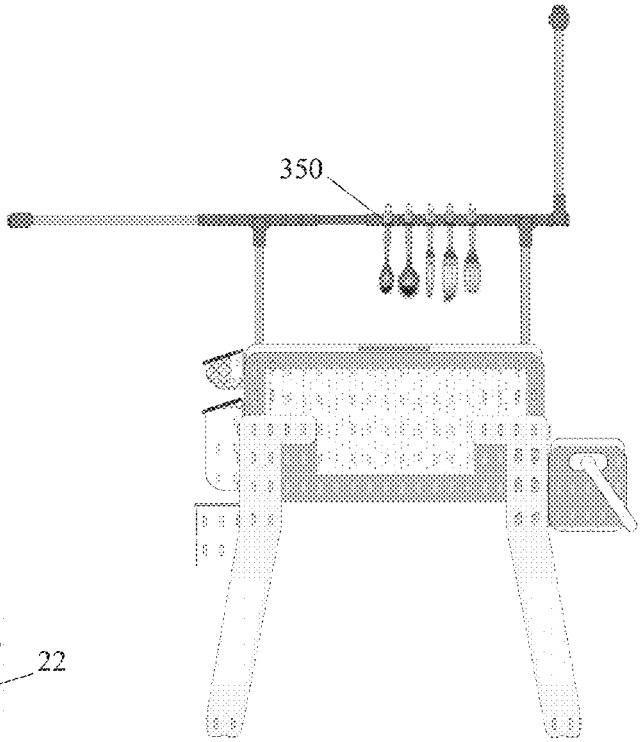
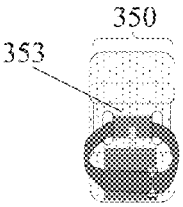
Fig. 43a
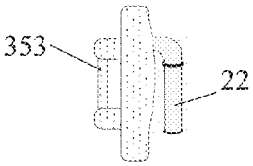
Fig. 43b
Fig. 43c

COOLER WITH EMBEDDED MATRIX OF CLEATS AND ATTACHABLE ACCESSORIES

CROSS REFERENCE TO RELATED APPLICATION

The following application is based on and claims the priority benefit of U.S. provisional application Ser. No.: 61/778,528 filed on Mar. 13, 2013 currently co-pending; the entire contents of which are incorporated by reference.

BACKGROUND

A cooler having an embedded matrix of cleats which substantially covers the internal and external surfaces of the cooler is provided. The cleats of the cooler correspondingly connect to and allow for the attachment of various articles, such as beverage holders, lid hinges, wheels, towing bar, leg attachments, handles, paper towel holders or seats, to be secured to the exterior or interior surface of the cooler. Dividers may be secured to the interior of the cooler so as to allow the compartmentalization of the interior cooler space. The cooler also has adjustable securing devices which allow a user to build his/her own securing attachment device to secure virtually any object to the cleats of the cooler.

Attempts have been made to provide a cooler which may be modified with attachments. U.S. Pat. No. 7,389,608 to MacKay discloses a fishing cooler that has wheels and a handle. The fishing cooler also features a plurality of cup holders, an externally removable and attachable rod holder, and a tackle box that can be attached either internally or externally. The fishing cooler has two internal compartments. The first compartment is for storing bait, and is smaller than the second compartment, which is for storing caught fish. Water can pass between each compartment, and a drain plug enables evacuation of all water inside of the cooler. Integrated on top of the cooler is a measuring line for such uses as measuring caught fish. The handle is hingedly connected at one side of the cooler, and extends when in use to enable the end user to pull the cooler behind he or she. The cooler may also include a drain cup and aerator that can be attached to either of the two drain plug holes. A portable light may be attached to the cooler.

U.S. Pat. No. 7,140,507 to Maldonado et al. discloses an improved insulated cooler has accessory holders detachably secured to its outer wall. An exemplary holder is provided for containerized drinks. The holder is made of a rigid plastic upper ring at the top and may have flexible fabric or mesh lower portion at the bottom such that the holders can be nested into receptacles in the top surface of the lid for convenient storage. This arrangement provides the benefit of permitting the user to access conveniently the contents of the ice chest without having to remove drinks that otherwise would be sitting on the lid of the ice chest. There also may be one or more connections on the ice chest that permit a fishing rod holder, an umbrella holder, or other accessory holder to be affixed to the cooler.

U.S. Pat. No. 6,153,857 to Gunnels discloses a portable food and utensil storage device includes a box like base component having a plurality of wheels attached to its bottom surface for rolling the device along a supporting surface. The interior of the base component includes a plurality of segregated compartments each configured and designed to retain hot or cold food items as well as various accessory items therein. The base component includes an opening adjacent its bottom surface in communication with an interior chamber for slidably receiving a gas fueled grill assembly. The top end of the base component is selectively coverable with a lid that pivotably engages the top edge of its rear wall. The inwardly facing side of the lid includes a plurality of bands and loops for retaining silverware, cups and similar items thereon.

However, these patents fail to disclose a cooler embedded with a matrix of cleats for receiving and holding various attachments. A need, therefore, exists for an improved cooler embedded with a matrix of cleats.

SUMMARY

A cooler having an embedded matrix of cleats which substantially covers the internal and external surfaces of the cooler is provided. The cleats of the cooler correspondingly connect to and allow for the attachment of various articles, such as beverage holders, lid hinges, wheels, towing bar, leg attachments, handles, paper towel holders or seats, to be secured to the exterior or interior surface of the cooler. Dividers may be secured to the interior of the cooler so as to allow the compartmentalization of the interior cooler space. The cooler also has adjustable securing devices which allow a user to build his/her own securing attachment device to secure virtually any object to the cleats of the cooler.

An advantage of the present cooler is that the present cooler may be altered depending on the desired function.

And another advantage of the present cooler is that the present cooler may have a removable seat portion.

Yet another advantage of the present cooler is that the cooler has adjustable attachments which allow a user to build his or her own securing mechanism to secure virtually any object to the cleats of the cooler.

Still another advantage of the present cooler is that the present cooler has removable handles which allows a user to selectively attach or remove a handle or carrying the handle.

Another advantage of the present cooler is that the present cooler allows for various articles to be attached at various locations on the exterior and interior surface.

BRIEF DESCRIPTION OF THE DRAWINGS

FIG. 28*c* depicts the LED light attachment attached to a boom kit attachment;

FIGS. 42*a-b* are a front view of a Velcro cinch attachment of varying size and a view of the Velcro cinch attachment installed;

FIGS. 43*a-c* are a front view and side view of a Velcro or elastic strap utensil or tool holder attachment;

DETAILED DESCRIPTION OF THE INVENTION

A cooler 1 having an embedded matrix of cleats 10 which substantially covers the internal and external surfaces of the cooler 1 is provided. The cleats 10 of the cooler 1 correspondingly connect to and allow for the attachment of various articles, such as beverage holders, lid hinges, wheels, towing bar, leg attachments, handles, paper towel holders or seats, to be secured to the exterior or interior surface of the cooler 1. Dividers may be secured to the interior of the cooler 1 so as to allow the compartmentalization of the interior cooler space. The cooler 1 also has adjustable securing devices which allow a user to build his/her own securing attachment device to secure virtually any object to the cleats 10 of the cooler 1.

Figure 1:
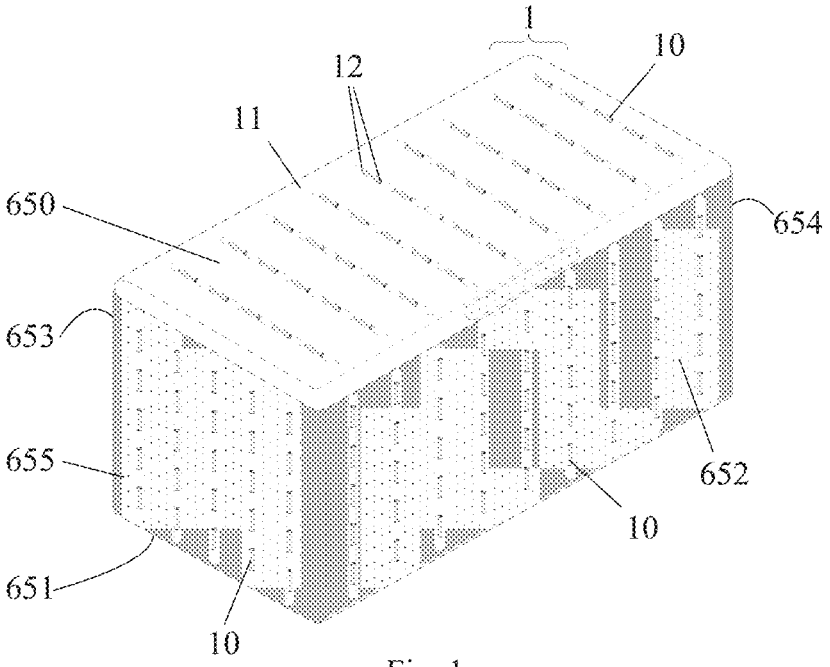
FIG. 1 is a perspective exterior view of a cooler with an embedded matrix of cleats on its surface.
Figure 2:
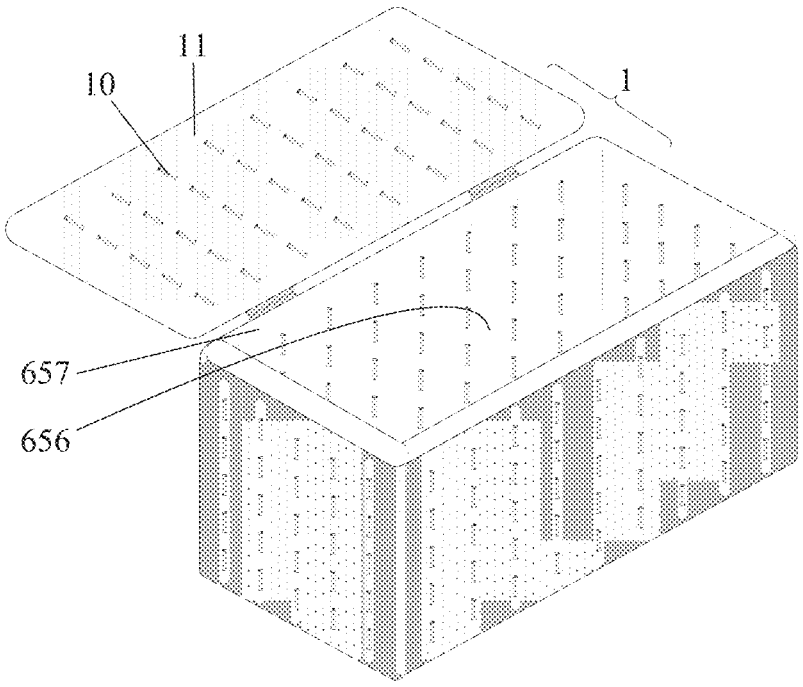
FIG. 2 is a perspective interior view of a cooler with an embedded matrix of cleats on its surface wherein the lid opens from the back of the cooler.
Figure 2A:
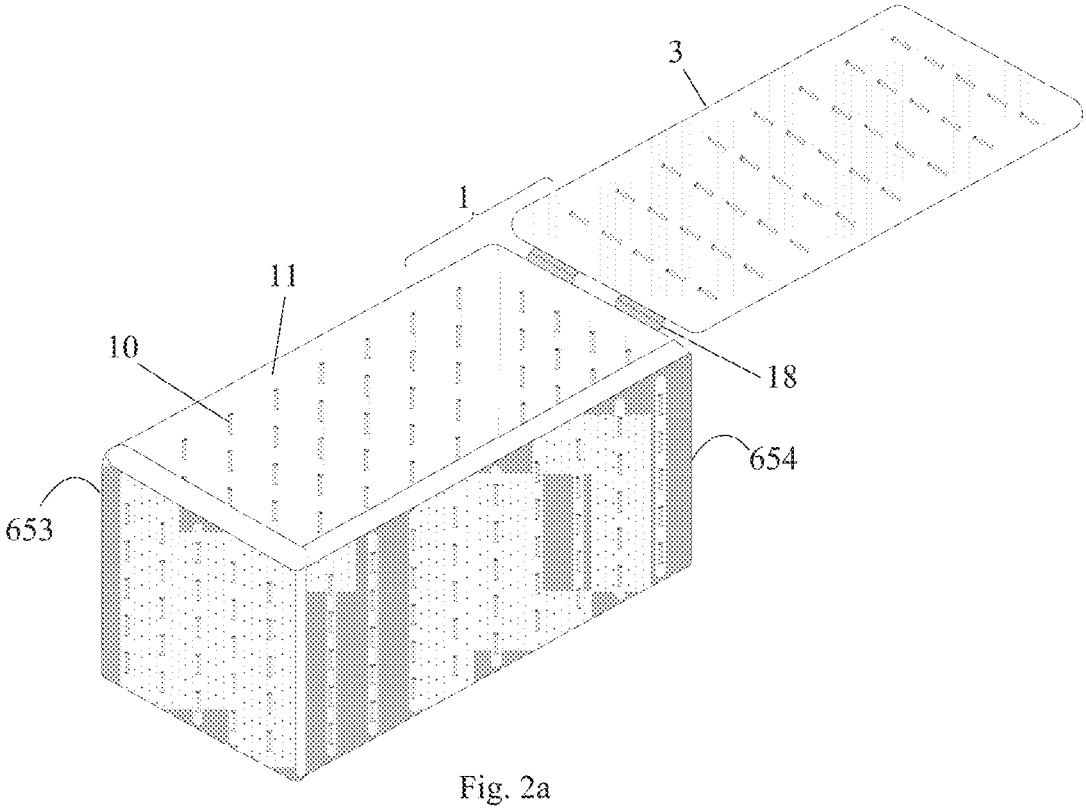
FIG. 2*a* illustrates a perspective view of the cooler with an embedded matrix of cleats on its surface wherein the lid opens from a side of the cooler.

As depicted in FIG. 1 and FIG. 2, the cooler 1 may have a top 650, a bottom 651, a front 652, a back 653, a first side 654, a second side 655, a generally hollow interior 656, an interior surface 657 and an exterior surface 2. The matrix of embedded cleats 10 may be used to adjust the overall structure of the cooler 1. Referring now to FIG. 2*a*, the cooler 1 may have detachable hinges 18 which secure a cooler's 1 lid 3 to the body of the cooler 1. The detachable hinges 18 may be attached to, for example, the back 653 or a side 654 of the cooler 1 enabling the lid 3 to be opened widthwise or lengthwise.

As stated above, the cooler 1 may be embedded with generally cylindrical openings (or "cleats") 10 in a matrix pattern which substantially covers the interior surface 657 (within the interior 656 of the cooler 1) and/or exterior surface 2 of the cooler 1. More specifically, the cleats 10 may run both horizontally and vertically on all the surfaces of the cooler 1. In an embodiment, the surfaces of the cooler 1 may have a plurality of recessed flutes 11 into which the cleats 10 are aligned and embedded (a cleat 10 is embedded inside a flute 11). In an embodiment, the recessed flutes 11 are largely cylindrical in shape. The recessed flutes 11 may guide into place various prongs 20 attached to attachable accessories (described below) such that the prongs 20 of the attachable accessories may be quickly and easily inserted into the cleats 10. Preferably, approximately eighty-five percent of the exterior surface of each cleat 10 is located behind the exterior surface 2 of the cooler 1; therein approximately fifteen percent of the exterior surface of the cleat 10 extends beyond the exterior surface 2 of the cooler 1. The fifteen percent of the exterior surface of the cleat 10 that extends beyond the exterior surface 2 of the cooler 1 results in a slightly curved exterior surface of the cooler 1 where the cleats 10 are present. Having approximately eighty-five percent of the exterior surface of the cleat 10 located within the exterior surface 2 of the cooler 1 provides stability to the cleats 10 and therein protects the cleats 10 and the objects secured in the cleats 10 (as discussed below).

Figure 3:
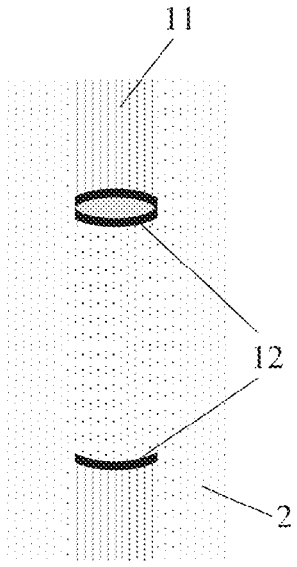
FIG. 3 is a front view of a single embedded cleat.
Figure 4:
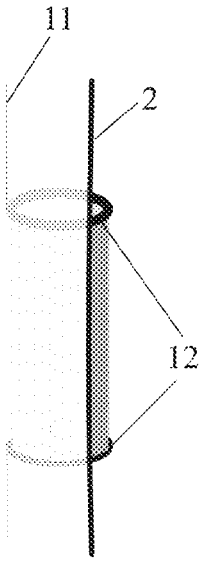
FIG. 4 is a side view of a single embedded cleat.
Figure 5:
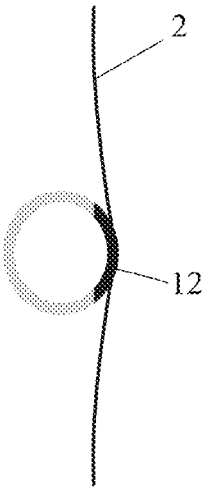
FIG. 5 is a top (or bottom) view of a single embedded cleat.

Referring now to FIGS. 3-5, the cleats 10 may be embedded into the exterior surfaces 2 and/or the interior surfaces 657 of the cooler 1 wall and may be located within the flute 11. In particular, the cleat 10 may be embedded substantially behind the exterior surface 2 and/or interior surface 657 of the cooler 1. In an embodiment, a smooth bushing 12 may be located on both ends of the cleat 10. In an embodiment, during use, the smooth bushings 12 may be the only portion of the cleat 10 which is exposed beyond the surfaces of the cooler 1.

Figure 6:
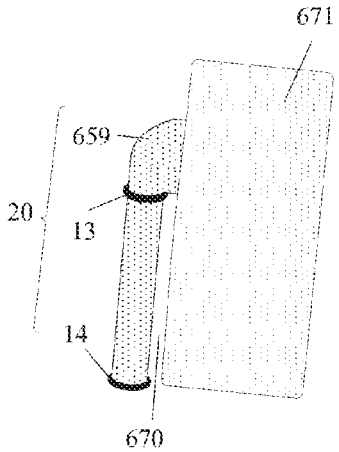
FIG. 6 is a side view of a prong affixed to an exemplary attachment.

A plurality of various attachments may be selectively secured, via prongs 20, to the surfaces of the cooler 1. For example, FIG. 6 illustrates attachments containing one or more prongs 20. The prongs 20 may secure the attachment to the cooler 1 when the attachment is inserted into a cleat 10. In an embodiment, the prong 20 may have a bend 659 which is approximately ninety degrees on one end which is fused into the attachment. As a result, a gap 670 is created between a base 671 of attachment and the prong 20 wherein the gap 670 is slightly larger than the thickness of the surfaces of the cooler 1. On the prong 20, adjacent to the bend 659, may be a top ring 13 (or "stop") which prevents the prong 20 from being inserted further into the cleat 10. At the other end of the prong 10 may be a bottom ring 14 which may be larger in diameter than the prong 20 but small enough so as to fit through the cleat 10. Therefore, the ring 13 at the top end is greater in diameter than the ring 14 at the bottom end of the prong 20. The bottom ring 14 may enable the prong 10 to snap into place after being inserted into a cleat 10. The distance between the larger top ring 13 and the smaller bottom ring 14 may be substantially the same in length as the cleat 10. In an embodiment, the top ring 13 and bottom ring 14 are made of rubber or plastic.

Figure 6A:
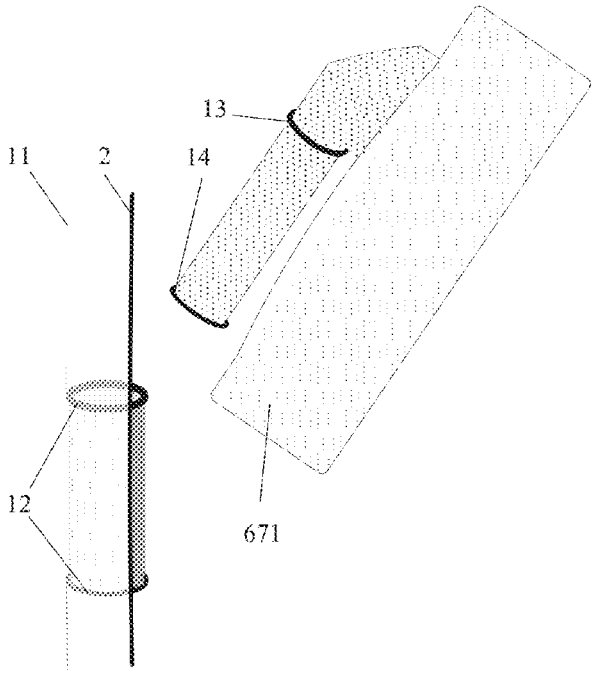
FIGS. 6*a*-6*b* illustrate a prong of an attachment in the process of being inserted and fully inserted into an opening of the cooler.
Figure 6B:
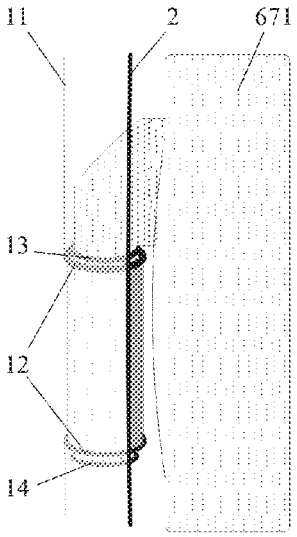
Figure 7A:
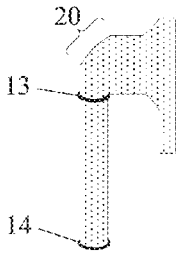
FIGS. 7*a-c* is a side view of prongs of different lengths.
Figure 7B:
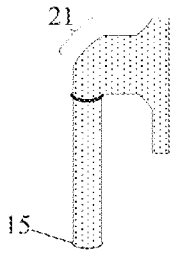
Figure 7C:
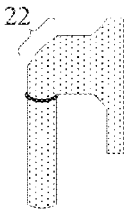

Referring now to FIGS. 6, 6*a* and 6*b*, in an embodiment, a prong 20 may be temporarily secured within a cleat 10. FIG. 6*a* illustrates a prong 20 in the process of being inserted into one of the cleats 10 of the cooler 1. Preferably, the prong 20 is inserted at an angle into the cleat 10 so as to allow the shaft of the prong 20 to be guided into the cleat 10 by the flute 11. FIG. 6*b* illustrates a prong 20 properly secured within a cleat 10 and an attachment secured to the prong 20. In this FIG. 6*b* orientation, the cooler 1 may be used having the removable attachment secured to the cooler 1. To remove the attachment from the cooler 1, the prong 20 (or attachment) is pulled so that the prong 20 is removed from the cleat 10 by a reverse process. The user may then select an alternative attachment (ie: the user may switch a cup holder attachment for a tray attachment) to secure to the cooler 1. Alternatively, a user may remove the attachment and may place the attachment within the generally hollow interior 656 of the cooler 1 for transportation and/or storage. Referring now to FIGS. 7*a*-*c*, the cooler 1 may have approximately three different types of prongs 20, although it should be understood that other types of prongs 20 may be implemented. The first type of prong may be a snap prong 20. The snap prong 20 may have a top ring 13 and may have a bottom ring 14 which may be used for rugged applications which require the accessory to be snapped securely into place. A snap prong 20 enables attachments to be secured to the cooler 1 in any direction, including top to bottom, bottom to top, left to right, or front to back. A second type of prong may be a snug prong 21. The snug prong 21 may contain a thinner bottom ring 15 which allows an attachment to be attached or detached with a minimal amount of force. The snug prong 21 may be used in association with attachments which are repeatedly attached and detached during use. Finally, a hook prong 22 may be used. The hook prong 22 may be shorter than the snap prong 20 and shorter than the snug prong 21 as the hook prong 22 does not contain a bottom ring 15. The hook prong 22 may allow the attachments to hang or rest on a cooler 1 and be attached and detached with minimal force.

Figure 8:
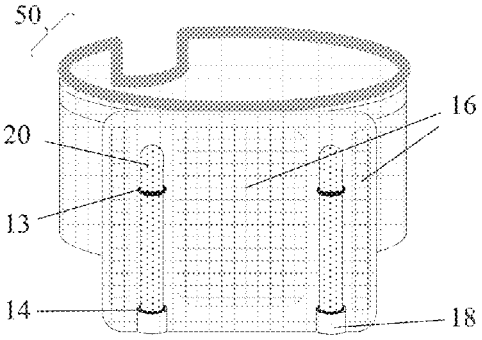
FIG. 8 is a rear view of a cup holder attachment.
Figure 9:
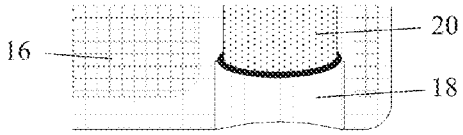
FIG. 9 is a close-up of a cleat guide on the rear of an exemplary attachment.

Referring now to FIG. 8, a cup holder 50 is shown from the back side. The back side may be the side of the attachment which faces the cooler 1. The cup holder 50 may be firmly attached to the cooler 1 using, for example, two snap prongs 20 which contain both a top 13 and bottom ring 14. The surface of the back side of the cup holder 50 attachment may bulge slightly on either side of the snap prong 20 to form a raised protrusion herein referred to as a nub 16. The nubs 16 on the back of most attachments slide against the surface of the cooler 1 when the accessory is attached and may further provide a slight outward force when the accessory is snapped or hooked into place on the cooler 1. In further detail in FIG. 9, a recessed notch with dimensions slightly larger than the outer surface of a cleat 10 is shown in the exemplary attachment just below the bottom of each prong 20. This notch is referred to as a cleat guide 18 and may be used to quickly position the attachment over the cleat 10 prior to sliding it into place.

Figure 10:
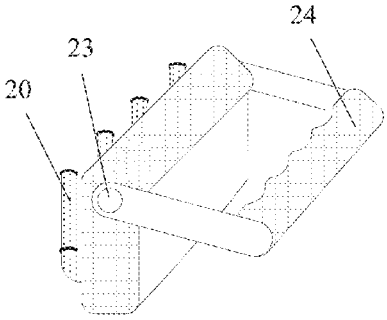
FIG. 10 is a perspective view of a handle attachment.

Referring now to FIG. 10, the cooler 1 may have a handle attachment which may be attached in any row of cleats 10 on the cooler 1. The handle attachment contains a row of prongs 20 which attach upwards into the cleats 10 on the sides of the cooler 1. The handle 24 in this attachment is sturdy and has a comfortable grip. When lifted, the handle 24 rotates freely on an axel 23 which is enclosed inside the base of the handle attachment. The handles may be attached to one of the top rows of cleats 10 so as to maximize the stability of the cooler 1 while the cooler 1 is being carried. The handles may be attached to one of the bottom rows of cleats 10 to raise the height of the cooler 1 above the carrier's knees and thighs while being carried. The handles may also be repositioned or removed simply to be out of the way of another attachment.

Figure 11A:
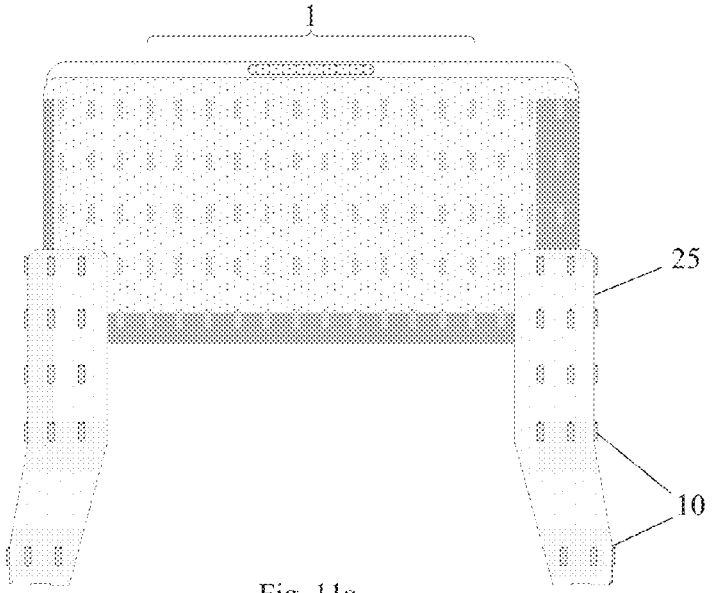
FIGS. 11*a-f* illustrate views of the leg attachments of the device.
Figure 11B:
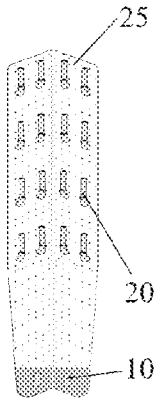
Figure 11C:
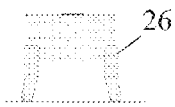
Figure 11D:
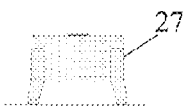
Figure 11E:
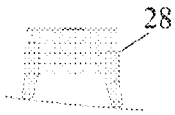
Figure 11F:
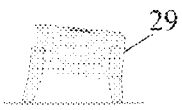
Figure 12A:
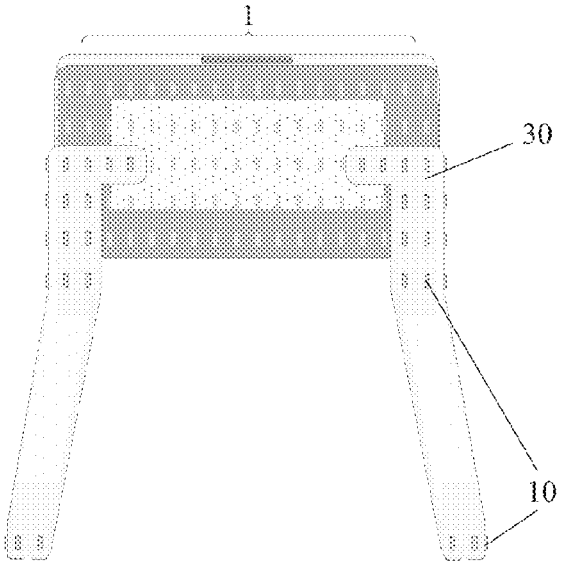
FIG. 12*a* is a front view of long leg attachments added to the cooler.

Referring now to FIG. 11*a* and FIG. 12*a*, the cooler 1 may have upright supports, herein referred to as legs, which may be attached to coolers 1 of varying size allowing the top of the cooler 1 to function more comfortably and with greater stability as a stand or table. Referring now to FIG. 11*b*, the cocktail table legs 25 contain rows of prongs 20 on the inside and rows of cleats 10 on the outside. The prongs 20 attach upward into the cleats 10 on the corners of the cooler 1. The cocktail table legs 25 may be positioned to create a taller table surface 26, as depicted in FIG. 11*c*, or a shorter table surface 27, as depicted in FIG. 11*d*. The number of possible height adjustments depends on the number of rows of cleats 10 on the cooler 1. Referring now to FIG. 11*e*, the cocktail table legs 25 may also be positioned to form a level table surface even on unlevel ground 28. Referring now to FIG. 11*f*, the cocktail table legs 25 may also be positioned to allow the cooler 1 to drain 29 for an extended period of time.

Figure 12B:
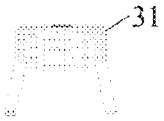
FIGS. 12*b-c* are views of long leg attachments added to the cooler.
Figure 12C:
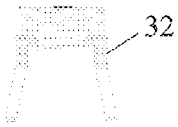

Still referring to FIG. 12*a*, the serving table legs 30 function in a similar manner as the cocktail table legs 25 in FIG. 11*a* and can be positioned to form a lower serving table 31, as depicted in FIG. 12*b*, or a higher serving table 32, as depicted in FIG. 12*c*. The rows of cleats 10 on the outside surface of the legs 30 allow for additional accessories to be attached.

Figure 13A:
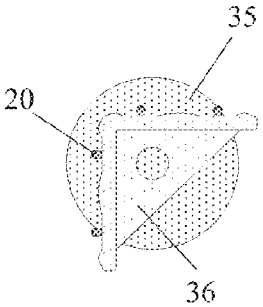
FIGS. 13*a-c* depict the top, side, and installed view of a leveling foot attachment.
Figure 13B:
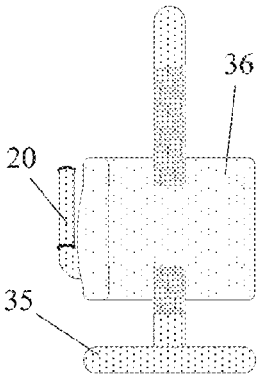
Figure 13C:
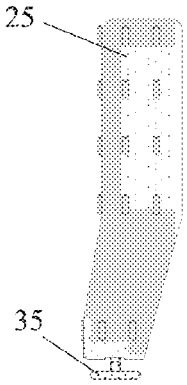
Figure 14:
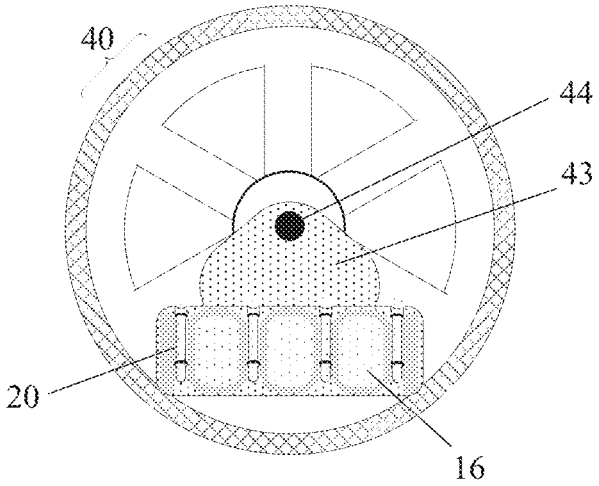
FIG. 14 is a rear view of an exemplary wheel attachment.

Referring now to FIGS. 13*a*-*c*, the cooler 1 may have a two-piece leveling accessory which may be attached to each leg 25. The two-piece leveling assessor may be an accessory which includes a leveling foot 35 and a leveling base 36, wherein the leveling base 36 attaches to the inside of a serving table or cocktail table leg 25. The leveling base 36 may contain a row of prongs 20 which allow the accessory to be attached upwards into the bottom of the leg 25. The leveling base 36 may contain a threaded hole in its center into which a threaded leveling foot 35 may be inserted and turned. Turning the leveling foot 35 in a counter clockwise (or counter-clockwise) manner may increase the overall height of the leg 35. Conversely, turning the leveling foot 35 in a clockwise (or counter-clockwise) manner may decrease the overall height of the leg 25. The leveling accessory may be intended to be used as a set of four and may include a small level attachment with a hook prong 22 which allows it to be attached to any open cleat 10 on the cooler 1.

Figure 16A:
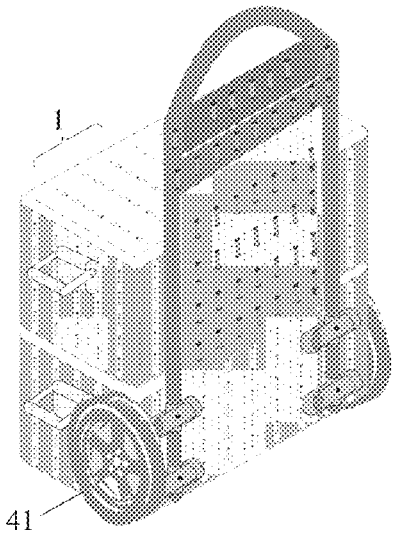
FIGS. 16*a-b* contain perspective views of sample towing handle, tray table, and wheel attachments.
Figure 16B:
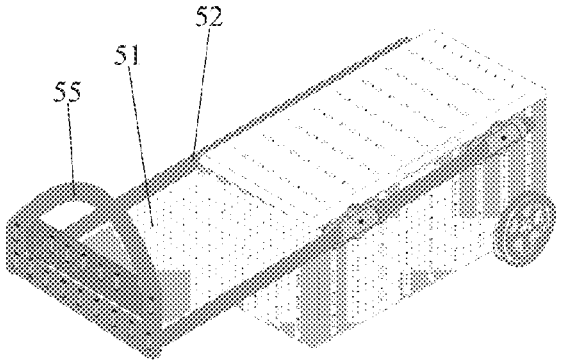

Referring now to FIGS. 16*a-b* the cooler 1 may have a removable wheel attachment 40 which may be attached in a lower row of cleats 10 on any side of the cooler 1. The wheel attachment base 43 may contain a row of prongs 20 which may attach upwards into the cleats 10 on the sides of the cooler 1. When turned, the wheel attachment base 43 rotates freely on the wheel axel 44 which is enclosed inside the wheel. The cooler 1 may have wheel attachments 40 of varying size. FIG. 16*a* shows a large commercial grade wheel attachment 41 attached to the short side of a cooler 1. FIG. 16*b* shows and a standard size wheel attachment 42 attached to the long side of a cooler 1. The wheel attachment 40 may also be attached to the bottom of the cocktail table legs 25 in FIG. 11*a* and the server table legs 30 in FIG. 12*a*.

Figure 15:
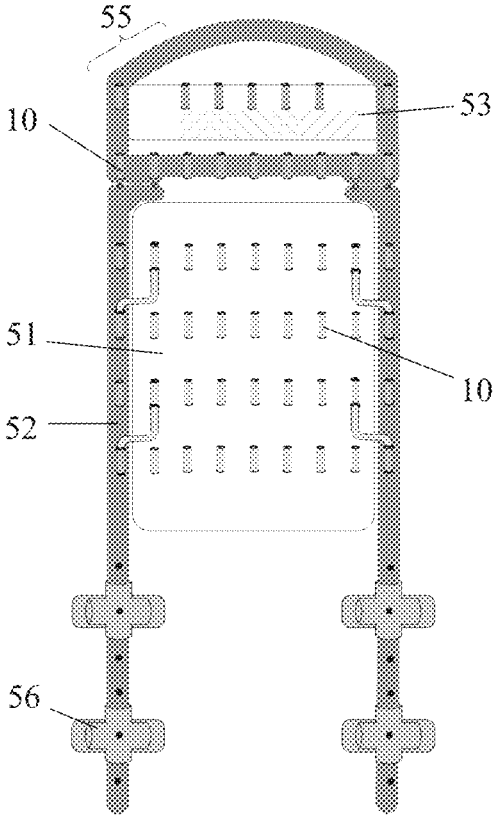
FIG. 15 is a rear view of a tow handle attachment and tray table attachment.

Referring now to FIG. 15 and FIG. 16*a*, the cooler 1 may have a tow handle attachment 55 which may be attached to the back side of medium to large size coolers 1. The tow handle attachment 55 may be comprised of two vertical tow bars 52, a horizontal tow handle 53, a tray table 51, and four two-way tube connectors 56. The tow handle 53 may contain a row of prongs which connect to cleats 10 at the top end of the tow bars 52. The tow bars 52 may be inserted into the two-way tube connectors 56 which in turn are attached in a vertical fashion to the side of the cooler 1. The tray table 51 may be attached in between the two tow bars 52 adjacent to the tow handle 53. Referring now to FIG. 16*b*, the tow handle attachment 55 may convert to a tray table attachment 51 by dismantling the vertical tow bars 52 from the cooler 1 and reattaching them in a horizontal fashion to the top row of cleats 10 on opposite sides of the cooler 1. All components in the tow handle attachment assembly 55 may be embedded with cleats 10 to stow accessories during transport or when the cooler 1 is not in use. The tray table 51 may have embedded cleats 10 on the bottom side and may further have a smooth surface on the top side.

Figure 17:
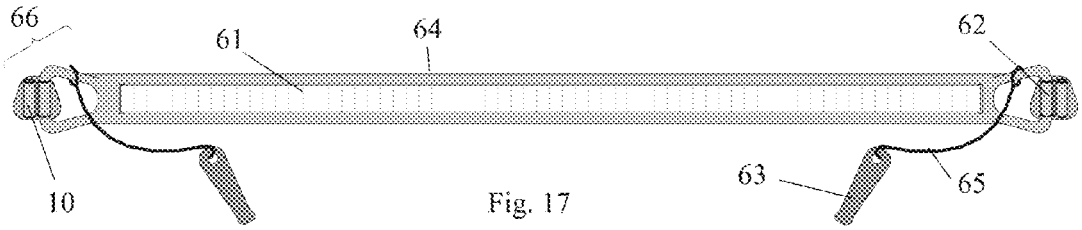
FIG. 17 is a front view of the trash bag holder attachment.
Figure 18:
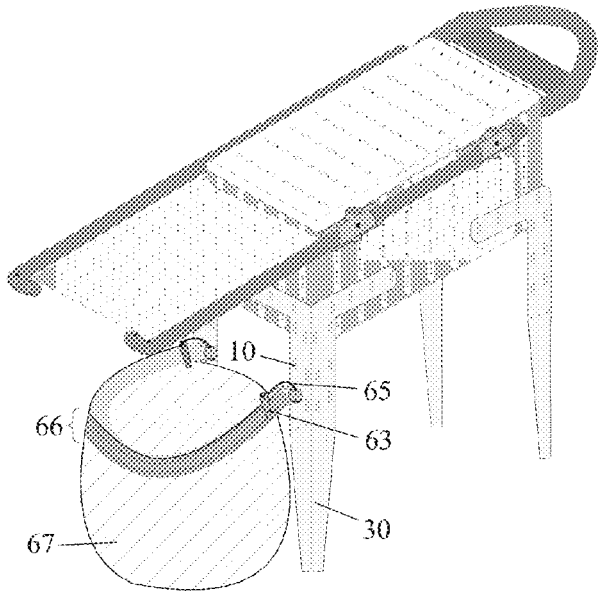
FIG. 18 is a perspective view of the trash bag holder attachment.

Referring now to FIG. 17 and FIG. 18, the cooler 1 may have a trash bag attachment 66 which may be attached to the sides of the cooler 1 or other attachments in a plurality of positions. The structural component of the trash bag attachment 66 may be comprised of a sturdy flexible track 64 which is easily, and temporarily, bent into a circle. An elastic band 61 may be connected to either end of the flexible track 64. A small attachment base 62 may be connected to each end of the track 64. The attachment base 62 may connect with the track 64 via a hinge which allows the track to swivel left or right 180 degrees. Both the track and the hinge may be sturdy enough so as to prevent the track 64 from bending up or bending down unless moderate force is applied. If bumped or bent, the flexible track 64 may spring back into place. The attachment base 62 may attach to an open cleat 10 on the sides of the cooler 1 or another attachment in a downward fashion using a single prong. Also attached to the each attachment base 62 via a tether cord 65 is a trash bag clip 63.

Still referring to FIG. 18, a trash bag attachment 66 may be attached to two serving table legs 30. A trash bag 67 may be held in place by folding the trash bag 67 over the top edge of the track 64 from inside the circle and then tucking the trash bag 67 under the elastic band 61 on the outside thus securing it into place. The two clips 63 secure the trash bag 67 in the open position on the track 64. The size of the trash bag 67 opening may depend on how far apart the attachment bases 62 and clips 63 are positioned from one another.

Figure 19A:
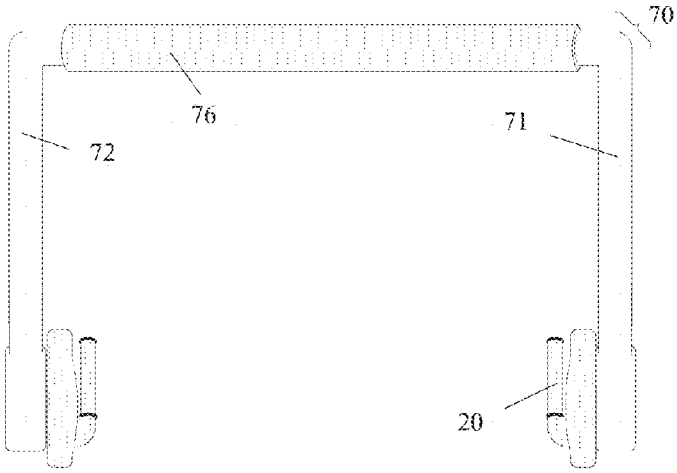
FIGS. 19*a-c* depicts a front view and a cross section view of the lunch pail attachment.
Figure 19B:
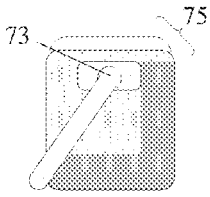
Figure 19C:
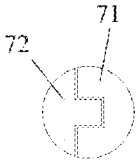

Referring now to FIGS. 19*a-c*, the cooler 1 may have a lunch pail handle attachment 70 which may be used to carry small coolers 75 or large attachments. The lunch pail handle attachment 70 may be a three-piece assembly. The handle 70 may be assembled by inserting a left lunch pail handle 72 and a right lunch pail handle 71 into opposite ends of the lunch pail handle sleeve 76 and sliding them together to match the width of the cooler 1 to be carried. Both the left and right handle pieces may be connected to an attachment base via a swivel 73 which allows approximately a three hundred-and-sixty degree movement. The attachment base may contain a row of prongs 20 which attach upwards into cleats 10 on the side of the cooler 1. By the sliding the left lunch pail handle 72 and the right lunch pail handle 71 farther apart or closer together, the lunch pail handle attachment 70 may be used to carry smaller or larger coolers. Furthermore, the lunch pail handle attachment 70 may be used to carry other objects with embedded cleats 10 which are similar in size to a small cooler.

Figure 20A:
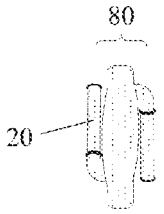
FIGS. 20*a-b* are side views of a sidecar attachment.
Figure 20B:
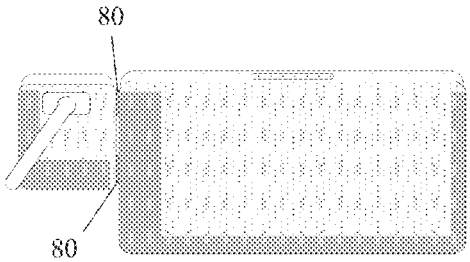

Referring now to FIGS. 20*a-b*, the cooler 1 may have a sidecar attachment 80 which is used to connect two coolers 1 together. The most practical use of the sidecar attachment 80 may be to connect a small cooler to a large cooler whereby the small cooler is referred to as a sidecar. The sidecar attachment 80 may contain a row of prongs 20 facing downward on one side and a corresponding row of prongs 20 facing upwards on the other side. A sidecar arrangement is formed by inserting the sidecar attachment 80 upwards into the side of the small cooler and downwards into the side of the large cooler leaving the small cooler to hang on the large cooler. Two sidecar attachments 80 positioned over one another are required to create a sidecar arrangement.

Figure 21:
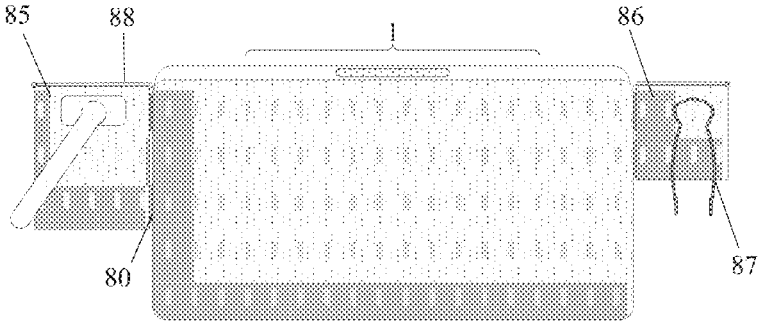
FIG. 21 is a side view of a large and a small ice pail attachment.

Referring now to FIG. 21, the cooler 1 may have an ice pail attachment 85 of varying size. The large ice pail attachment 85 may be a box whose length is similar to the width of a standard-size cooler 1. Further, the ice pail attachment 85 may have thin walls which are not insulated. The exterior surface of the ice pail attachment 85 may contain a matrix of embedded cleats 10 which may be identical in size and spacing as the cooler 1. The small ice pail attachment 86 may be similar in construction to the large ice pail attachment 85 but with smaller dimensions. Enclosing the top of the ice pail attachment may be a hinged lid 88 having a recessed handle which opens upwards and away from the cooler 1. The ice pail attachments 85, 86 may be attached to the cooler 1 using the sidecar attachment 80. The lunch pail handle 70 is shown in FIG. 21 attached to the large ice pail attachment 85. The cooler 1 may have a tong attachment 87 having a hook prong 22 for use in conjunction with the ice pail attachments 85, 86. The ice pail attachment 85 may be used to carry and store other items in addition to ice.

Figure 22A:
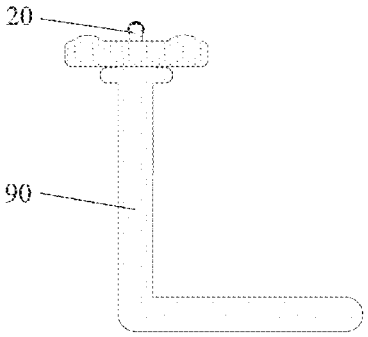
FIGS. 22*a-b* are top views of the towel bar attachment.
Figure 22B:
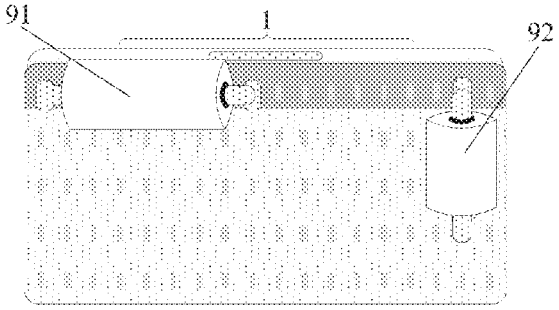

Referring now to FIGS. 22*a-b*, the cooler 1 may have an adjustable towel bar attachment 90 which may be used to hold, for example, a roll of paper towels. The towel bar attachment 90 may be intended to be used in pairs with each bar being inserted into opposite ends of the roll. The construction details of the towel bar 90 may include an 'L' shaped bar with a single prong attachment base which is affixed to one end. The bar may be attached to its base on a swivel which allows the towel bar 90 to turn approximately three hundred-and-sixty degrees in either direction relative to the direction in which the prong 20 is pointing. This feature may allow the towel bar to be attached horizontally 91 or vertically 92 on the side of the cooler 1 or other large attachment. A ratchet feature in the swivel may prevent the towel bar 90 from being turned without a moderate application of force. Larger rolls may be accommodated by attaching the opposing towel bar attachments 91 farther apart. Smaller rolls may be accommodated by attaching the opposing towel bar 92 attachments closer together.

Figure 23:
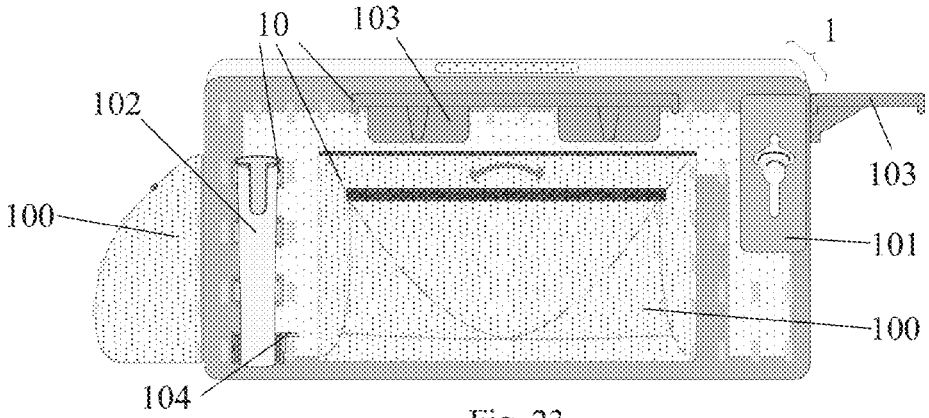
FIG. 23 includes a front and side view of a cutting board attachment, a front and side view of a tote bag attachment, the front view of a bottle opener attachment, and the front view of a rod holder attachment.

Referring now to FIG. 23, the cooler 1 may have a cutting board attachment 103 which may be used as a cutting board, a sturdy shelf, or small serving area. The back of the cutting board attachment 103 may contain a row of prongs pointing in the downward direction. On both ends of the board are extra cleats 10 for attaching small single-pronged accessories.

Also referring to FIG. 23, the cooler 1 may have a bottle opener attachment 101 which is able to remove a bottle cap by inserting the bottle into the open hole in the opener and pressing downward with one hand while simultaneously holding the cooler 1 in place with the other hand.

Also referring to FIG. 23, the cooler lmay have a tote bag attachment 100 of varying size which is intended to store cooler accessories during transit or when the cooler 1 is not in use.

The tote bag attachment 100 may be constructed of mesh fabric and may include a large zippered pocket and handle. The back of the tote bag attachment 100 may contain rows of prongs which are pointed in the downward direction allowing the tote bag attachment 100 to hang on the side of the cooler 1 when attached. The tote bag may expand when full and may lie flat when empty. Still referring to FIG. 23, the cooler 1 may have a rod holder attachment 102 which is able to hold items such as an umbrella, fishing rod, flag pole, or other objects of similar shape. The rod holder attachment 102 may contain a rod holder ring 104 at the bottom which holds the rod in place when closed or allows the rod to fall through to the ground when opened. The ring may support a flag and/or umbrella when the cooler 1 is used in conjunction with the serving table leg attachment 30. The construction details of the rod holder attachment 102 may also include a slot for a fishing reel and extra cleats 10 to replenish those that were covered up by the attachment 102.

Figure 24:
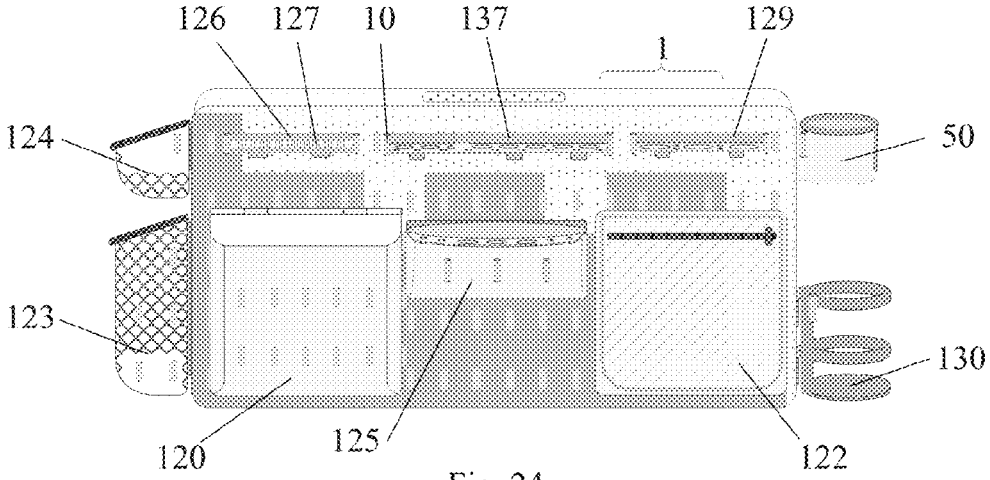
FIG. 24 includes a front view of the hard-sided pocket, rigging strip, tool rack, caddy, and re-sealable pouch attachments.

Referring to FIG. 24, the cooler 1 may have caddy attachments of varying size. The construction details of the caddy attachment 125 may include a hard-sided pocket without a lid. The caddy may have, for example, one or two broad protruding lips wrapped around the front of the pocket. The lips may contain holes into which small tools, such as pliers and screwdrivers, may be inserted. The back side of the caddy attachment 125 may contain a single row of prongs which are pointed in the downward direction allowing the caddy attachment 125 to hang onto the side of the cooler 1 when attached.

Also referring to FIG. 24, the cooler 1 may have a rigging strip attachment 126 of varying size. The construction details of the rigging strip attachment 126 may include a strip 127 of firm, spongy material with vertical slits cut into the attachment 126 across its length approximately one centimeter apart. These slits may be intended to be used to hold, for example, fish hooks, fishing lures, fishing line, and other fishing tackle. The back side of the rigging strip may contain a single row of prongs which are pointed in the downward direction allowing the rigging strip attachment 126 to hang onto the side of the cooler 1 when attached.

Still referring to FIG. 24, the cooler 1 may have a tool holder attachment 129 of varying size. The construction details of the large tool holder attachment 129 may include a broad protruding lip from one end of the attachment 129 to the other. The lip may contain several large holes into which large tools may be inserted. The back side of the tool holder attachment 129 may contain a single row of prongs which are pointed in the downward direction allowing them to hang onto the side of the cooler 1 when attached. The adjustable tool and hook holder attachment 137 may be a two-piece assembly whereby the right piece slides into the left piece allowing the attachment to be adjusted to the desired length prior to being attached. The construction details of the adjustable tool and hook attachment 137 may include two rows of holes, one being large enough to hold a small tool and the other small enough to secure a fishing hook or lure.

Figure 25:
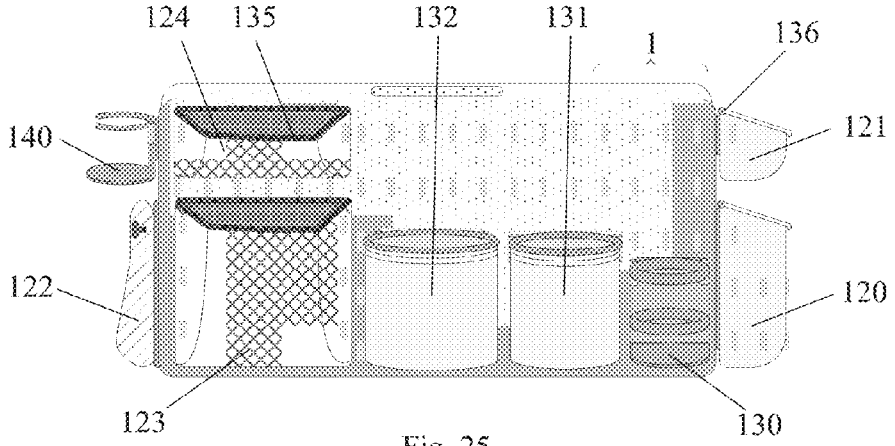
FIG. 25 includes a front view of the soft-sided pocket, 750 ml bottle holder, wine bottle holder, and 2-liter bottle holder attachments.

Referring now to both FIG. 24 and FIG. 25, the cooler 1 may include a hard-sided pocket attachment of varying size. The construction details of the hard-sided pocket may include a hinged lid 136 with a lip which slightly overhangs the front face of the pocket. The back side of the hard-sided pocket attachment 120 may contain one or more rows of prongs which are pointed in the downward direction allowing the pocket to hang onto the side of the cooler 1 when attached. Hard-sided pocket attachments 120 may be intended to store objects which are easily crushed or damaged. The small hard-sided pocket attachment 121 may be intended to store sunglasses but the attachment 121 may also be used to store other types of small objects.

Also referring to FIG. 24 and FIG. 25, the cooler 1 may include a soft-sided pocket attachment 123 of varying size. The construction details of the soft-sided pocket 123 may include a zippered enclosure 135. The back side of the soft-sided pocket attachment 123 may contain one or more rows of prongs which are pointed in the downward direction allowing the pocket to hang onto the side of the cooler 1 when attached. The small soft-sided pocket attachment 124 may be used to store sunglasses but the attachment 124 may also be used to store other types of small objects. Unlike the hard-sided pocket attachment 120 which opens when turned upside down, the soft-sided pocket attachment 123 zips shut so as to prevent its contents from falling out. This feature may allow it to be attached to either side of the cooler's 1 lid. The soft-sided pocket attachments expand when full and lie flat when empty.

Also referring to FIG. 24 and FIG. 25, the cooler includes a waterproof re-sealable pouch attachment 122 of varying size. The construction details of the waterproof pouch 122 include a transparent or opaque re-sealable enclosure. The back side of the waterproof re-sealable pouch attachment 122 contains one or more rows of prongs that are pointed in the downward direction allowing the pocket to hang onto the side of the cooler when attached. Similar to the soft-sided pocket attachment 123, the waterproof re-sealable pouch attachment 122 seals shut and may also be attached to either side of the cooler's 1 lid. The waterproof pouch attachment expands when full and lies flat when empty.

Also referring to FIG. 24 and FIG. 25, the cooler 1 may have a bottle and cup holder attachment 130 of varying size. The present cooler 1 may include bottle and cup holders 130 which are insulated and as well non-insulated. The back side of the bottle and cup holders 130 may contain one or more rows of prongs which are pointed in the downward direction allowing the bottle and cup holders to hang onto the side of the cooler 1 when attached. The 750 ml bottle holder attachment 130 may hold the bottle in place with a skeletal frame and is non-insulated. The wine bottle holder attachment 131 and the 2-liter bottle attachment 132 may be fully enclosed halfway up the bottle and may be well insulated. The cooler 1 may also have an insulated cup holder attachment 50 and a non-insulated cup holder attachment 140.

Figure 26A:
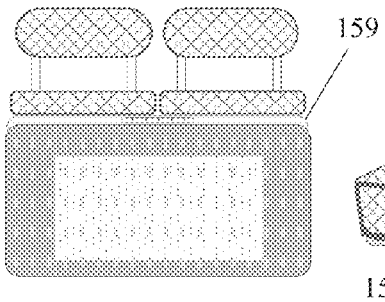
FIGS. 26*a-c* are front views of the seat cushion and hard back seat cushion attachments.
Figure 26B:
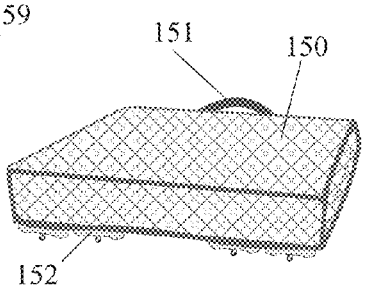
Figure 26C:
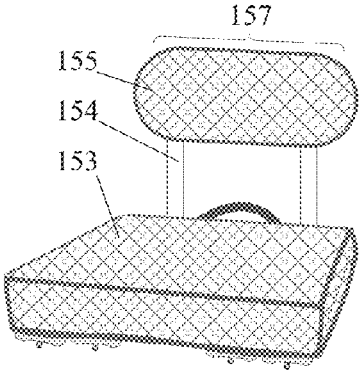

Referring now to FIG. 26, the cooler 1 may have a seat cushion attachment 150 which may be attached to the lid 159 of the cooler 1 to form a seat. The construction details of the seat cushion include a thick square of padding fully enclosed by a layer of durable water resistant fabric. On one side of the cushion is a cushion handle 151 that can be used to help carry the cushion or aid in attaching it to the cooler 1. The underside of the seat cushion may contain multiple rows of prongs 152 which are pointed in the same direction towards the handle. The seat cushion 150 may be attached to the cooler lid 159 by lining up the prongs on the cushion with the cleats 10 on the lid and then sliding it in the direction of the cushion handle 159.

Still referring to FIG. 26, the cooler 1 may have a hard back seat cushion attachment 157 which may be attached to the lid 159 of the cooler 1 to form a seat. The construction details of the seat cushion 153 on the hard back seat may be similar to the seat cushion 150. In addition, the hard back seat cushion includes a thick inflexible back rest 155 that is enclosed by a layer of durable water resistant fabric. On the front side of the back rest there is a layer of padding between the hard back and the fabric. The back rest 155 may be connected to the seat cushion 153 by two sturdy L-shaped supports 154 that are fastened to the back of the back rest on one end and permanently embedded inside the seat cushion on the other end. The hard back seat cushion attachment 157 may be attached to the cooler lid 159 in the same manner as the seat cushion attachment 150.

Figure 27:
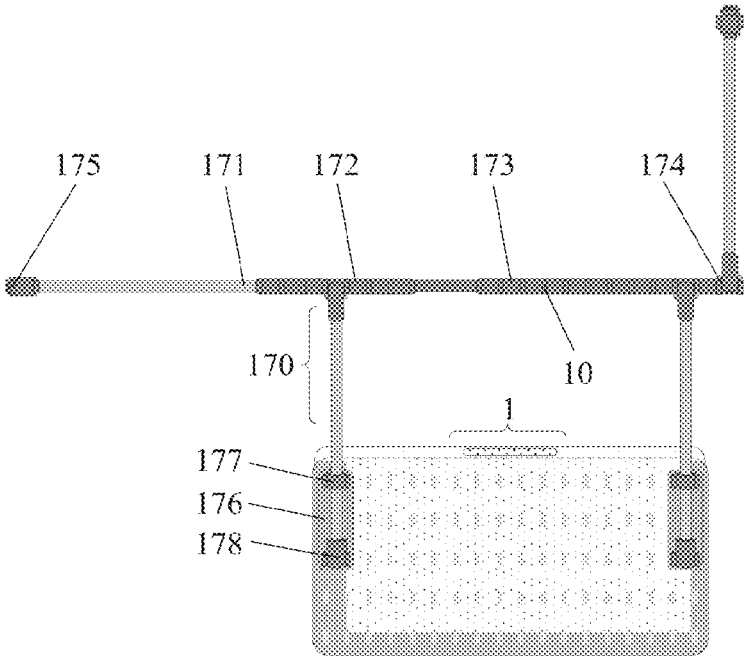
FIG. 27 is a rear view of the boom kit attachment.

Referring now to FIG. 27, the cooler 1 may include a boom kit attachment 170 which may be attached to any side of the cooler 1, the back side of the cooler 1 being the most advantageous location. The boom kit may include multiple pieces of boom 171, a left attachment rod 173, a right attachment rod 172, multiple pieces of boom bracket 174, multiple pieces of boom join 175, and two boom bases 176. The boom 171, also referred to as an upright, is a tube with screw threads on each end. The left attachment rod 173 may be a tube with a threaded coupling on its left end into which a boom 171 may be inserted and screwed into place. The right attachment rod 172 is similarly constructed with a threaded coupling on its right end. The left half of the right attachment rod 172 has a reduced diameter that allows it to be inserted into the right end of the left attachment rod 173. The construction of the two pieces of the attachment rod allows it to be adjusted to the desired length.

Still referring to FIG. 27, the boom join 175 of the boom kit attachment 170 may contain a threaded coupling on both ends. The join 175 may be used to connect two pieces of boom together or the join 175 may be used simply as an end cap. The boom bracket 174 may contain a threaded coupling on one end and a U-shaped connector with prongs on the other end. The boom bracket allows a piece of boom 171 to be connected in a perpendicular fashion to a plurality of attachment points on either the left attachment rod 173 or right attachment rod 172. Boom pieces may be used to elevate the attachment rod to the desired height above the cooler 1. Boom pieces may also attached outward as an extension of the attachment rod or upright to create a short vertical pole above the attachment rod.

Still referring to FIG. 27, boom pieces may be attached to the cooler 1 via a boom base 176. The back side of the boom base 176 may contain one or more rows of prongs which are pointed in the downward direction allowing the boom base to hang onto the side of the cooler 1 when attached. The front side of the boom base 176 may have two loops that wrap around a boom 171 piece. The top loop 177 in the boom base may be open on both ends allowing the boom piece to slide through it. The bottom loop 178 contains a thread coupling into which a boom piece is screwed when attached. To form a fully assembled boom kit, the boom bases are attached apart from one another on the same row on the same side of the cooler. All components of the boom kit, except for the boom 171 pieces, contain cleats 10 into which other attachments maybe attached.

Figure 28A:
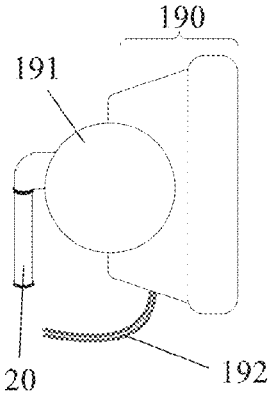
FIGS. 28*a-c* are side and front views of the LED light attachment. In addition.
Figure 28B:
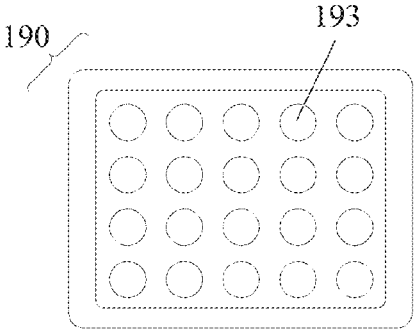
Figure 28C:
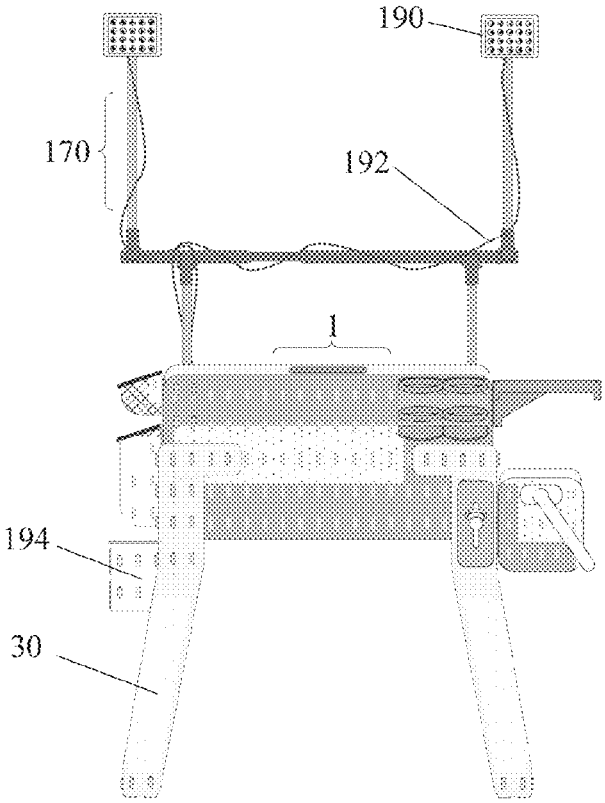

Referring now to FIGS. 28*a-c*, the cooler 1 may have a LED light attachment 190 which may be attached to any side or lid of the cooler 1, or to other attachments. The LED light attachment is ideally suited to be attached to the ends of the boom kit attachment 170. The construction details of the LED light attachment 190 may include an array of LED lights 193 enclosed behind a transparent front cover. The back side of the LED light attachment 190 contains a row of prongs that are pointed in the downward direction. The LED light fixture is attached to its base on a LED light swivel 191 that allows it to turn a total of 180 degrees relative to the direction in which the prong 20 is facing. The prong 20 can also turn a total of 180 degrees left or right inside the swivel. This feature allows the LED light attachment 190 to point upward, downward, left, or right when attached. There is a ratchet feature in the LED light base and swivel that prevents the light fixture from being turned without a moderate application of force. The ratchet feature also allows the light fixture to point in intermediate positions between left and right or up and down.

Still referring to FIG. 28, the LED light attachment 190 operates on common DC battery power. The battery is housed in an external hard-sided battery holder attachment 194 that may be attached to any side of the cooler 1. The back side of the battery holder contains one or more rows of prongs that are pointed in the downward direction allowing the battery holder to hang onto the side of the cooler or another accessory when attached. The battery holder attachment 194 in FIG. 28 is shown attached to the serving table leg attachment 30. A thin LED light power cord 192 links the LED light attachment 190 with the battery inside the battery holder attachment 194. The power cord is detachable on both ends and may be threaded through the hollow center of the boom kit attachment 170, or it may simply be wrapped around it as shown in FIG. 28.

Figure 29A:
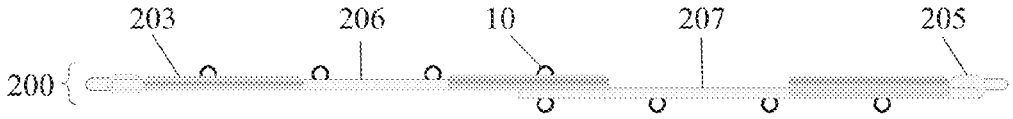
FIGS. 29*a-b* are top and side views of the interior bypass divider attachment.
Figure 29B:
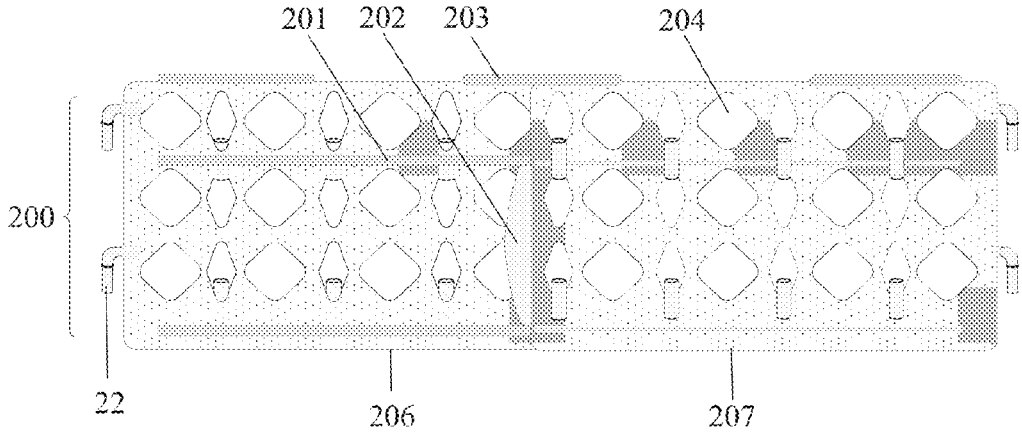
Figure 30A:
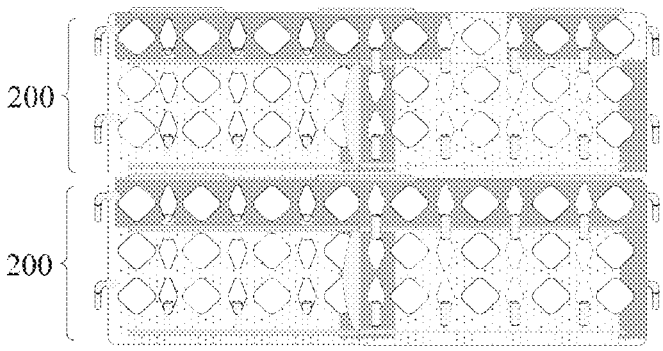
FIGS. 30*a-b* are side views of stacked interior divider attachments and a top view of multiple interconnected interior dividers attached to the inner walls of the cooler.
Figure 30B:
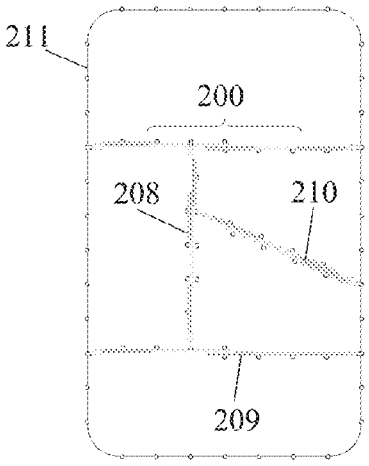

Referring now to FIGS. 29*a-b*, in an embodiment, the cooler 1 may have an interior divider attachment 200 that may be attached to the cleats in the interior of the cooler 211. The construction details of the interior divider include a pair of hook prongs 22 vertically arranged on both ends that are pointed in the downward direction allowing the divider to hang onto cleats on the interior walls of the cooler 211. The divider has large holes 204 that allow air and water to pass through it. In an embodiment, the holes 204 are small such that ice cannot generally pass through the divider attachment 200. As a result, the user may more easily separate goods stored in the cooler 1 based on desired temperature. The interior divider attachment 200 may be comprised of a left interior divider blade 206 and a right interior divider blade 207. The left blade contains upper and lower blade guides 201 that hold the right blade into place. The left blade also contains rows of cleats 10 on the opposite side of the guides. The right blade contains a tab 202 that inserts into the upper and lower guides on the left blade. The right blade also contains rows of cleats 10 on the same side as the tab. The interior divider attachment 200 is assembled by inserting the tab 202 on the right divider blade 207 in between the guides on the left divider blade 206 and sliding the two blades together.

Still referring to FIGS. 29*a-b* and 30*a-b*, the bypass design of the interior divider attachment 200 may allow the length of the divider to be adjusted by sliding the left and right blades towards each other or away from each other. A large overlap of the blades creates a shorter divider 208. A small overlap of the blades creates a longer divider 209. Also because of the bypass design, the hook prongs 22 on the right interior divider blade 207 are offset 205 by the width of the blade; whereas, the prongs on the left interior divider blade 206 are in line with the blade. Interior divider attachments 200 may be attached to the interior of the cooler 211 or to each other 208. The interior divider attachments 200 may be attached perpendicular to the side of the cooler or on an angle 210.

Still referring to FIGS. 29*a-b* and 30*a-b*, the interior divider attachment 200 may be stacked on top of one another to form a taller divider. In this configuration, the bottom edge of the divider blades may rest upon the blade guide 203 that is part of the top edge of the left divider blade 206 and right divider blade 207.

Figure 31A:
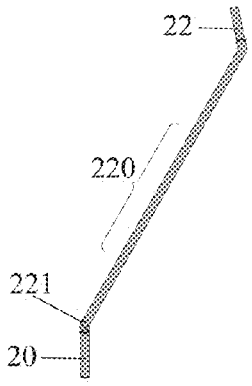
FIGS. 31*a-b* are side views of the lid prop attachment and a front view of the lid prop attachment attached inside the interior of a cooler.
Figure 31B:
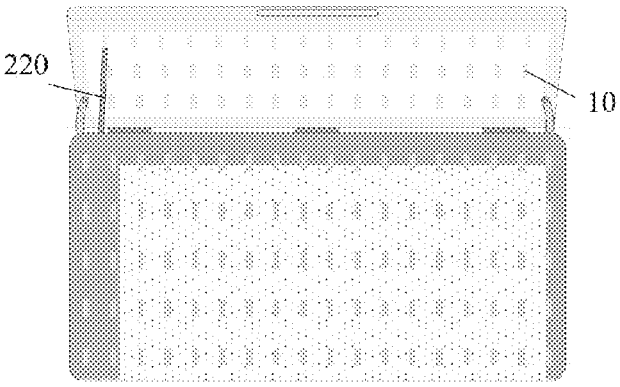

Referring now to FIG. 31, the cooler 1 may have a lid prop attachment 220 which may be attached to the cleats 10 on the interior side wall and lid of the cooler 1. The top end of the lid prop may contain a hook prong 22 which easily hooks into the cooler lid to prop it open. The bottom end of the lid prop contains a snap prong 20 that is attached to a cleat on the interior side wall of the cooler. The bottom prong is attached to the lid prop with a sturdy prop hinge 221. This hinge allows the lid prop to fall away towards the bottom of the cooler when unhooked from the top, leaving the bottom prong still conveniently attached to the cleat 10. The lid of the cooler 1 may be propped open at different height positions by attaching the hinged end or the hooked end to higher or lower cleats 10 on the cooler 1 or lid.

Figure 32A:
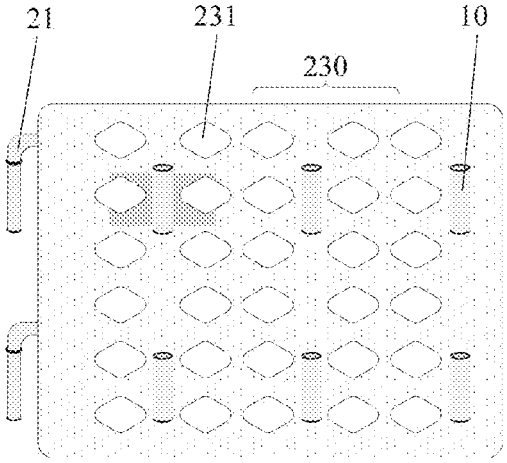
FIGS. 32*a-b* are side views of the small interior compartment attachment and a top view of exemplary interior compartment attachments attached inside a cooler.
Figure 32B:
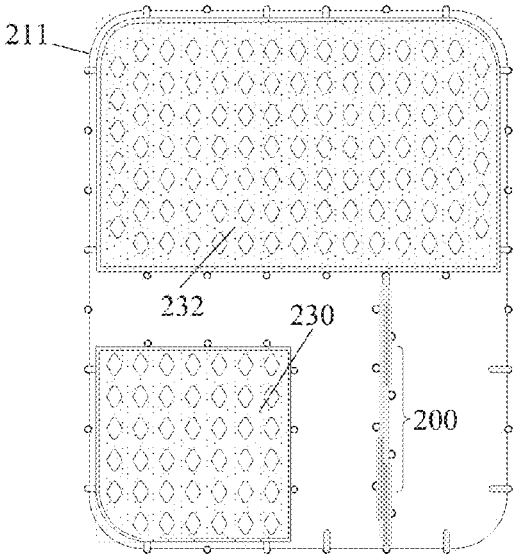

Referring now to FIG. 32, the cooler 1 may have interior compartment attachments of varying size. The construction details of the interior compartments include two or more rows of snug prongs 21 on the two adjacent sides. The two sides with prongs are referred to as the outer sides; whereas the two sides without prongs are referred to as the inner sides. The prongs on the outer sides are pointed in the downward direction allowing the compartment to hang in the corner of the interior of the cooler 211. The small interior compartment attachment 230 has large holes 231 on its side and bottom surfaces that allow air and water to pass through. The small interior compartment contains rows of cleats 10 on the two inner sides that do not contain prongs.

Still referring now to FIG. 32, the large interior compartment 232 is similar in construction to the small compartment but contains prongs 21 on three sides. The interior compartment attachments are stackable and can be used in combination with different size compartments or other attachments, including above, underneath, and alongside the interior divider attachment 200. In light applications, the interior compartment attachments may also be attached to the exterior sides of the cooler 1 or its accessories.

Figure 33:
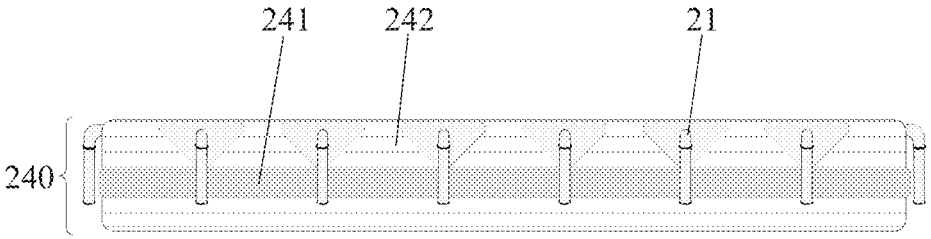
FIG. 33 is a side view of the liner attachment.

Referring now to FIG. 33, the cooler 1 may have a liner attachment 240 of varying size to match each size of cooler 1. The liner is intended to be used as a protective layer on the bottom of the cooler 1 or as a separator that inhibits the flow of air and liquids between layers in the cooler 1, the latter providing thermal protection to the contents in bottom half while the cooler is being frequently opened and closed. The construction details of the liner attachment 240 include a row of snug prongs 21 on all four outer sides that are pointed in the downward direction allowing the liner to hang onto the interior sides of the cooler 1. The liner may be made from of a flexible rubbery material 242 that is waterproof. The liner seal 241 may be a thick smooth continuous strip of rubbery material that wraps completely around the outside of the liner. When attached, the bases of the prongs 21 press the liner seal 241 firmly against the inner walls of the cooler 1.

Figure 34A:
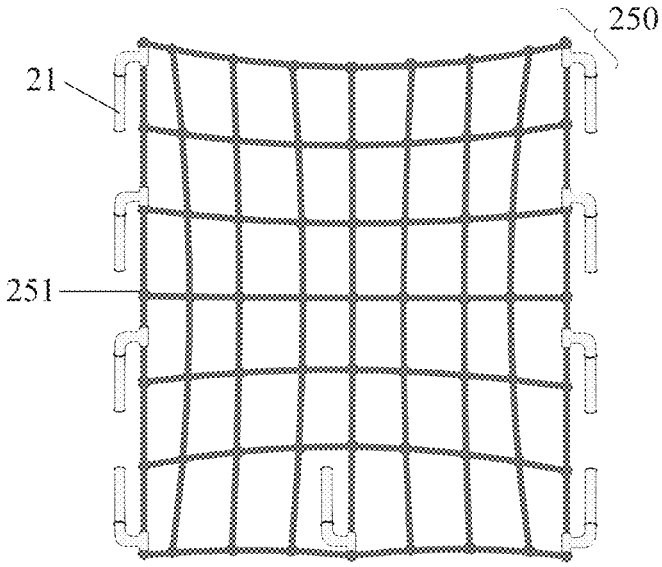
FIGS. 34*a-b* are a front view of the ice pack net attachment and a top view of multiple ice pack holder attachments attached inside the interior of a cooler.
Figure 34B:
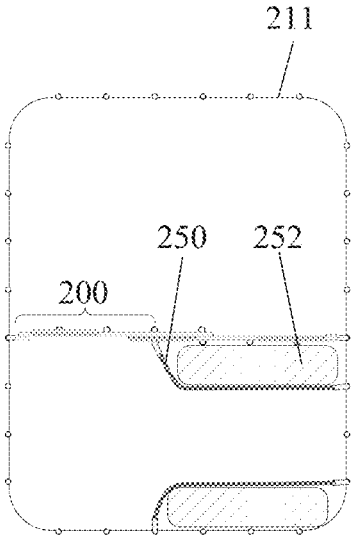

Referring now to FIGS. 34*a-b*, the cooler 1 may have an ice pack net attachment 250 of varying size. The ice pack net may include netting 251 made of elastic cord with a row of snug prongs 21 on three sides. Except for the bottom row, the prongs are pointed in the downward direction allowing the ice pack net to hang onto the interior sides or lid of the cooler 211 or on an interior divider 200. The prongs in the bottom row are pointed upwards. The ice pack net attachment 250 is attached to the cooler by attaching the bottom prongs first and stretching the netting upwards until the remainder of the prongs can be inserted downward. The ice pack net attachment does not contain prongs on its top side allowing objects, such as an ice pack 252, to be stowed in it. The elastic characteristics of the netting pull the top prongs and the bottom prongs together securing the attachment to the cooler 1. The elastic netting also applies moderate pressure to secure the ice pack net's contents into place.

Figure 34C:
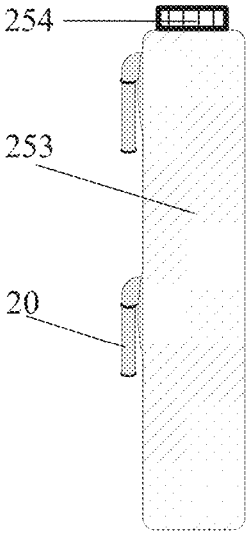
FIGS. 34*c-d* are side views of the ice pack attachment and a top view of multiple ice pack attachments attached inside the interior of a cooler.
Figure 34D:
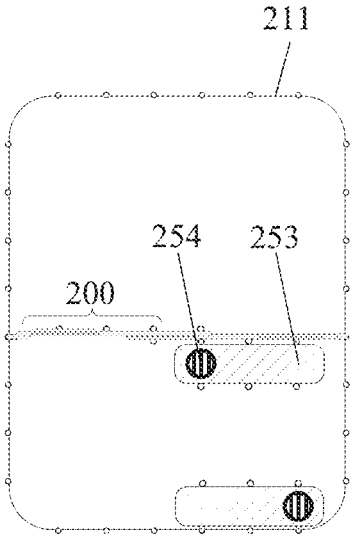

Referring now to FIGS. 34*c-d*, the cooler includes an ice pack attachment 253 of varying size. The construction details of the ice pack include two rows of snap prongs 20 on one side that are used to secure the ice pack attachment to the interior walls of the cooler or other accessories. In an embodiment, the prongs 20 may be pointed in the downward direction allowing the ice pack attachment to hang onto the interior sides or lid of the cooler 211 or on an interior divider 200. The ice pack attachment may be hollow. Water or other liquids may be poured into the ice pack attachment 253 and secured with the ice pack attachment cap 254.

Figure 35A:
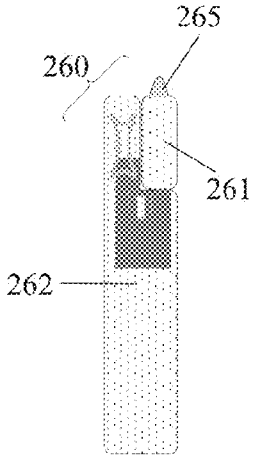
FIGS. 35*a-c* are front and side and installed views of the thumb latch attachment.
Figure 35B:
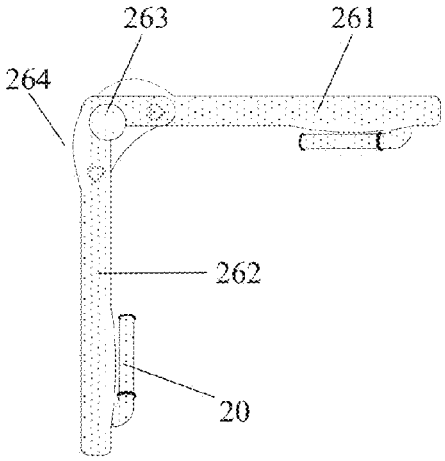
Figure 35C:
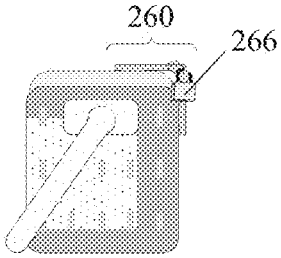

Referring now to FIGS. 35*a-c*, the cooler 1 may have a thumb latch attachment 260 which may be used to snap or lock the cooler lid in the closed position to the body of the cooler 1. The latch may be comprised of two pieces, an upper latch 261 and a lower latch 262. The upper latch attaches to a cleat on the front row of the cooler's lid. The lower latch attaches to a cleat 10 on the top row on the front of the cooler's 1 body. The cleats to which the upper latch and lower latch are attached need to be in the same cleat column. The construction details of the upper latch 261 include a single snap prong 20 that is pointed towards the front of the cooler 1 when attached. The upper latch includes a protrusion on its top-front corner that is used as a finger grip 265 to help spread the upper and lower latches apart when opening. The construction details of the lower latch 262 include a single snap prong 20 that is pointed towards the top of the cooler when attached. The lower latch includes a protrusion on its top-front corner that is used as a thumb grip 264 to help spread the upper and lower latches apart when opening. When installed on a cooler, the upper and lower latches have opposing ridges that snap together when the lid is fully closed. The latch is opened by simultaneously pulling the upper latch to the right with a forefinger and pushing the lower latch to the left with a thumb.

Still referring now to FIGS. 35*a-c*, the upper latch 261 has a circular hole near its front end below the finger grip 265. The lower latch 262 also has a circular hole 263 near its top end behind the thumb grip 264. When the latch 260 is in the closed position, the aforementioned holes are aligned with each other allowing a lock 266 or cable tie to be inserted and used to prevent the cooler from being opened.

Figure 36A:
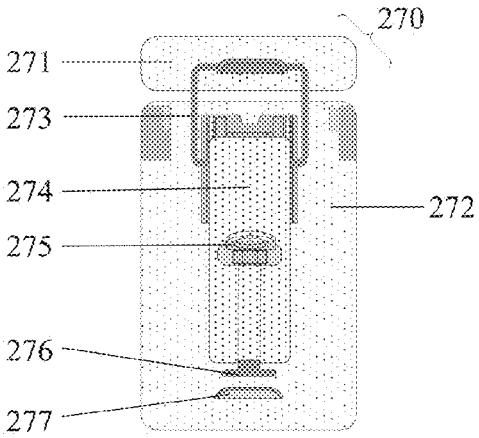
FIGS. 36*a-b* are a front and side view of the draw latch attachment.
Figure 36B:
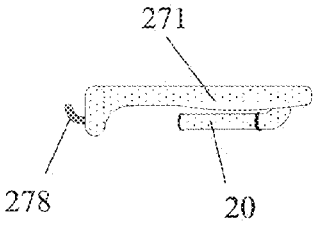

Referring now to FIGS. 36*a-b*, the cooler 1 may have a draw latch attachment 270 for use in environments which are considered too rugged for the more basic latch attachment 260. The draw latch may be comprised of two pieces, an upper draw latch 271 and a lower draw latch 272.

The upper draw latch attaches to a pair of cleats 10 on the front row of the cooler's 1 lid. The lower draw latch attaches to a pair of cleats on the top row on the front of the cooler's 1 body. The cleats 10 to which the upper draw latch and lower draw latch are attached need to be aligned in the same cleat 10 columns. The construction details of the upper draw latch 271 include a pair of snap prongs 20 that are pointed towards the front of the cooler 1 when attached. The upper latch includes a latch keeper 278 on its front edge. The construction details of the lower latch 272 includes a pair of snap prongs 20 that are pointed towards the top of the cooler 1 when attached. The lower draw latch includes an under-center draw latch 274 with a latch loop 273 on its top and an adjustable length latch hook 276 on its bottom.

Still referring to FIGS. 36*a-b*, the draw latch is closed by lifting the latch loop 273 over the top of the upper draw latch keeper 278, placing the latch hook 276 below the lower draw latch keeper 277, and closing the under-center draw latch 274. The draw latch is opened by reversing the aforementioned process. The under-center draw latch also has a locking hasp 275 with a circular hole into which a lock can be inserted. Multiple draw latch attachments 270 can be used on larger coolers.

Figure 37:
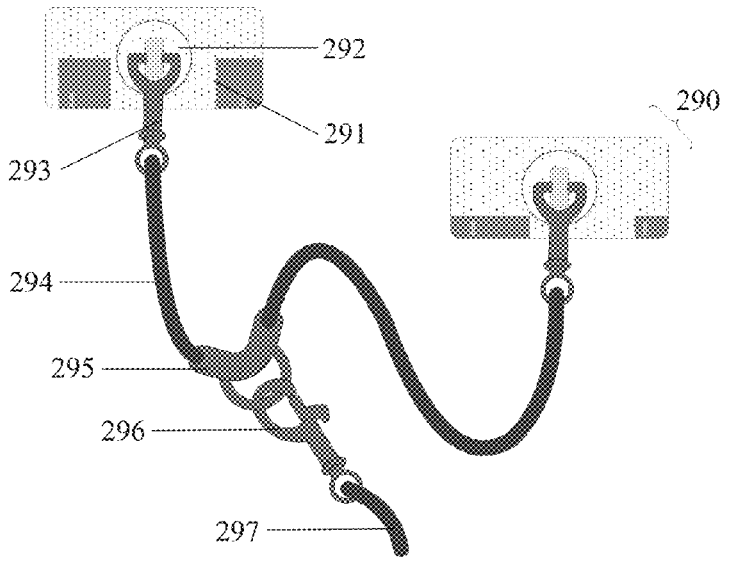
FIG. 37 is a front view of a tie down attachment.
Figure 38A:
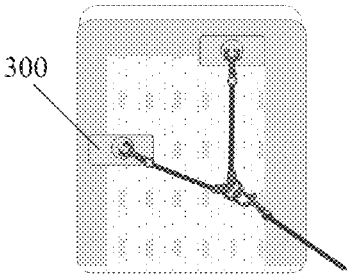
FIGS. 38*a-f* depict the different options of attaching a tie down attachment to a cooler.
Figure 38B:
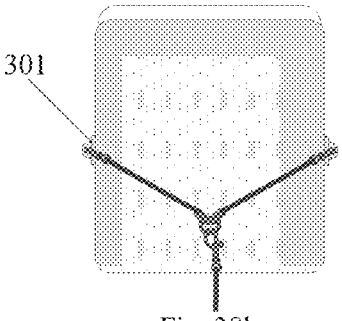
Figure 38C:
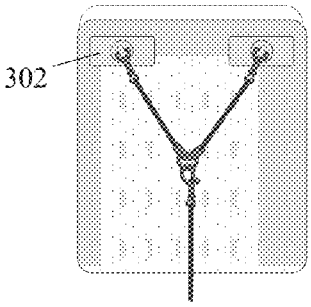
Figure 38D:
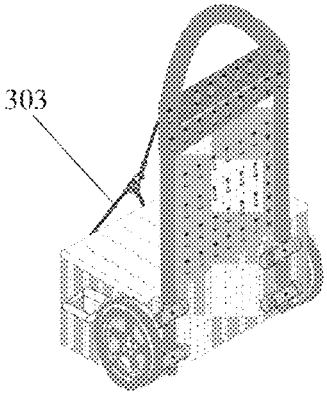
Figure 38E:
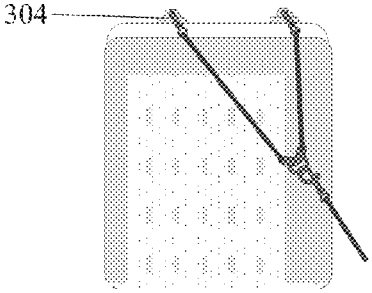
Figure 38F:
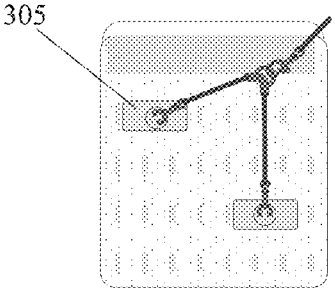

Referring now to FIG. 37, the cooler 1 may have a tie down attachment 290 that allows the cooler 1 to be secured to other objects or to secure other objects to the cooler 1. The construction details of the tie down attachment include a tie down base 291 with a row of prongs on its back side. On the front side of the tie down attachment base 291 is a tie down attachment loop 292 that is attached to the base on a swivel that allows it to turn 360 degrees in either direction relative to the direction in which the prongs are facing. Connected to the loop via a swivel eye hook 293 is a cord 294 that connects to a second hook, tie down loop and base through a cord cradle 295. The cradle is able to slide freely along the length of the cord from one tie down base to the other. Embedded into the side of the cord cradle is a large loop into which a second cord 297 is attached via a swivel eye spring hook 296.

Referring now to FIG. 37 and FIGS. 38*a-f*, the tie down attachment 290 may be connected to cleats 10 on the sides or lid of the cooler at any location. The tie down bases may be attached to opposing sides of the cooler 301 or on the same side 302. The prongs on the back of the tie down base may be positioned upward or downward on the sides of the cooler 1, depending on whether the cooler 1 is being secured upward 305 or downward 300, respectively. The prongs may also point backward or forward on the lid 304, as long as the cooler 1 is being secured downward. As a rule, the prongs must be pointed in the general direction in which the cord is to be pulled taught. If the angle between the direction of the prong and the cord exceeds 90 degrees, the tie down base will likely become detached from its cleats. In addition to securing the cooler 1 to an object, the tie down attachment 290 may also be used to secure objects to the cooler 303.

Figure 39A:
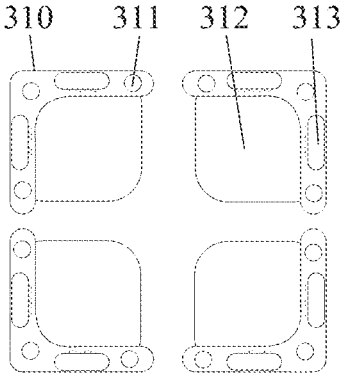
FIGS. 39*a-c* are a top and side view of a corner mount attachment.
Figure 39B:
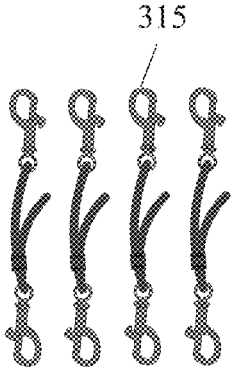
Figure 39C:
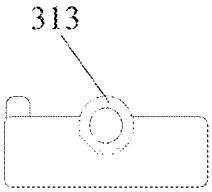

Referring now to FIG. 39, the cooler 1 may have a corner mount attachment which allows the cooler 1 to be mounted to a floor or deck. The corner mount attachment is part of a kit comprised of mounting screws, four corner mount footings 310, and four mounting cords 315. The construction details of the corner mount footings include a flat-topped L-shaped ridge facing upwards that is fitted to wrap around a bottom corner of the cooler 1. The kit includes a footing for each corner of the cooler 1. Through the center of the ridge pointing downwards are holes 311 for screws that are used to attach the footing to the deck. The base of the footing is a square-shaped lip 312 with rounded corners upon which the cooler will be positioned when mounted. On top of the ridge on both sides of the 'L' are loops 313 used to attach the mounting cords 315 that are used to secure the cooler to the footings. The cords are adjustable in length and include a swivel eye spring hook on both ends.

Figure 40:
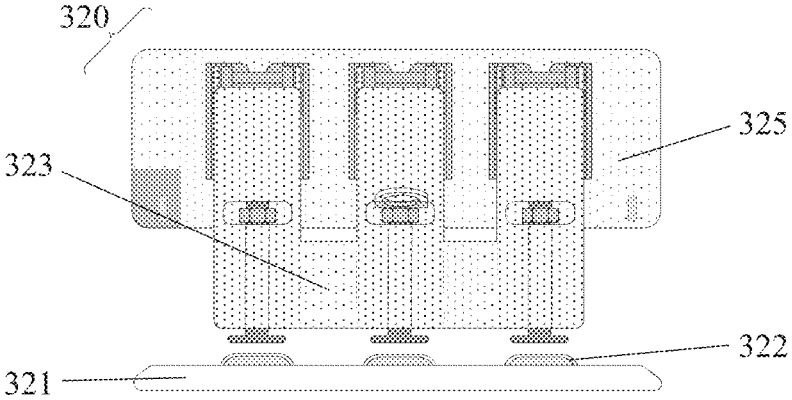
FIG. 40 is a side view of a flush mount attachment.

Referring now to FIG. 40, the cooler 1 may have a rugged flush mount attachment 320 which allows the cooler 1 to be firmly mounted to a floor or deck. The flush mount attachment is intended for marine and transportation applications. The flush mount latch 320 is part of a kit comprised of mounting screws, a thin rubber mat, two latches, two keeper plates 322, and two keeper cover plates 321. The construction details of the flush mount latch 320 include a triple under-center draw latch 323 on the front side of the latch base 325. The back side of the latch base contains a row of prongs that point downward in the direction of the deck to which the cooler will be mounted.

Still referring to FIG. 40, the flush mount latch needs to be attached to the lowest row of cleats on the cooler's 1 body. The triple keeper plate is attached with the mounting screws directly to the floor or deck. The keeper plate cover is snapped onto the triple keeper plate. The rubber mat goes underneath the cooler to protect the surface of the floor or deck. The rubber mat also provides upward tension when compressed by the cooler 1 at all times, which reduces the possibility of the cooler rattling or shifting while secured. The flush mount latches need to be attached to opposing sides of the cooler directly over the keeper plates. Larger coolers or ultra rugged applications may require multiple sets of flush mount attachment kits. The flush mount keeper plates 322 and covers 321 are rugged enough to be stepped upon. When compared to corner mount footings, their low profile reduces the risk of tripping or toe injury when the cooler is not in place.

Figure 41:
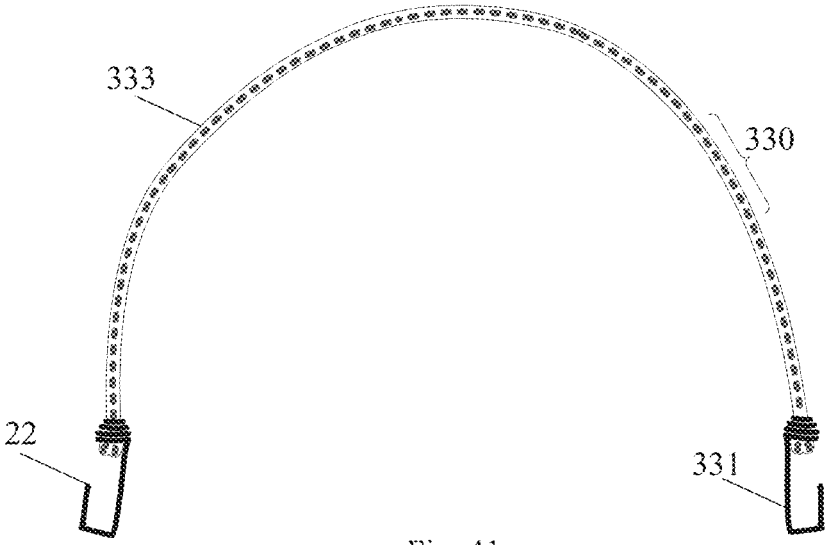
FIG. 41 is a side view of a bungee cord attachment of varying size.

Referring now to FIG. 41, the cooler includes a bungee cord attachment of varying size that is intended to be used to quickly secure items to a cooler without having to tie or untie any knots. The construction details of the bungee cord attachment 330 include an elastic cord 333 with a hook 331 connected to each end. The hook has corners at right angles, rather than rounded. The end of the hook is similarly constructed to a hook prong 22 so that the hook may be inserted into an open cleat anywhere on the cooler.

Referring now to FIGS. 42*a-b*, the cooler 1 may have a Velcro cinch attachment 340 of varying size which is intended to be used to quickly secure items to a cooler 1 without having to tie or untie any knots. The construction details of the Velcro cinch attachment 340 may include a flexible fabric strap 341 with a strap buckle 344 on one end and a Velcro tab 342 on the other end. The strap is fed through the strap buckle 344 and secured in place by folding the strap back onto itself. The strap may also be fed through a buckle that is built into the Velcro strap base 343. The base has a single prong on its back side that is pointed in a direction perpendicular to the slots in the base buckle 343. When fastened around an object, the diameter of the cinch can be adjusted by pulling or pushing the strap 341 through the strap buckle 344, which increases or decreases the length of the tab 342 when folded.

Referring now to FIGS. 43*a-c*, the cooler 1 may have a Velcro or elastic utensil or tool holder attachment 350 which is intended to be used to quickly attach small objects to a cooler 1. The construction details of the Velcro utensil or tool holder 350 may be similar to the Velcro cinch attachment 340, but with smaller components. In addition, the slots in the base buckle 353 are positioned vertically causing the strap to be positioned horizontally, which is perpendicular relative to the direction of the prong. A hook prong 22 is used in this attachment to allow objects to be easily detached from the cooler 1. The elastic version of the utensil or tool holder functions similarly to the Velcro version. The strap of the elastic version can be stretched over the top of the utensil or tool rather than being pulled apart and then strapped around it.

Figure 44A:
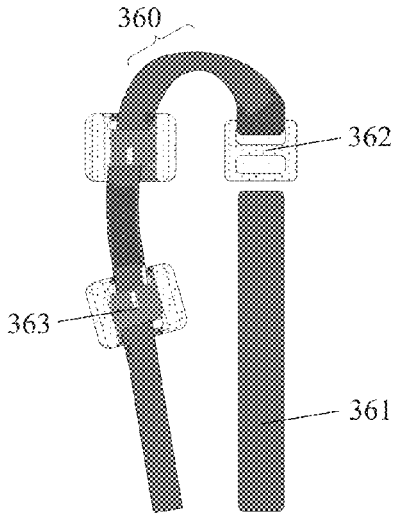
FIGS. 44*a-c* are a front view of a fabric strap attachment, a single drawstring attachment, and a double drawstring attachment.

Referring now to FIG. 44*a*, the cooler 1 may have a strong and pliable fabric strap attachment 360 of varying size which allows large objects to be secured to the cooler 1. The strap attachment is intended be used as part of a set of two and will secure objects in the horizontal position relative to the cooler 1. The construction details of the strap attachment include a strap 361, a strap buckle 362, and two strap bases 363. The strap bases contain a base buckle similarly positioned as in the Velcro cinch attachment 350. The base has a single prong on its back side that is pointed in a direction perpendicular to the slots in the base buckle. The strap 361 is permanently attached to the strap buckle 362 on one end. When in use, the strap is fed through the base buckle in both strap bases. The bases must point in opposite directions with the top base having its prong pointing downwards and the bottom base having its prong pointed upwards. The strap 361 may then be fed through the strap buckle 362 and tightened to secure the object. The strap attachment 360 takes longer to assemble and secure an object than the bungee cord attachment 330; however, the strap attachment is better suited when transporting heavy objects over rough terrain because it does not stretch and carries the weight of the object at two vertical points on the cooler 1.

Figure 44B:
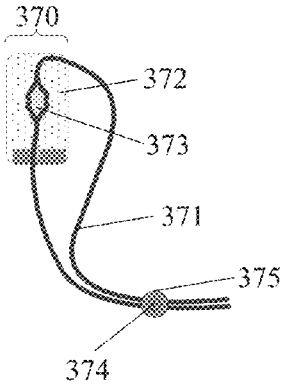

Referring now to FIG. 44*b*, the cooler 1 may have a single drawstring attachment 370 of varying size which allows small to medium size objects to be quickly secured to the cooler 1. The construction details of the drawstring attachment may include a drawstring 371 with a drawstring lock 375. The drawstring is comprised of two equal length cords that are fused together on one end and tied to a drawstring base 372 on the other end. The drawstring base contains a protruding eye hook 373 on its front side and a single prong on its back side. Objects are secured to the cooler 1 with a drawstring attachment 370 by first inserting it between the two cords and then pushing the drawstring lock towards the base until the cords are tight around the object. Objects are released from the drawstring attachment by pressing the release button 374 on the drawstring lock and sliding the lock away from the drawstring base. The drawstring cords 371 will not stretch allowing the object to stay secure during transport. However; the object may possibly bounce up and down during transport because the single drawstring attachment 370 only secures the object to the cooler 1 at one vertical position.

Figure 44C:
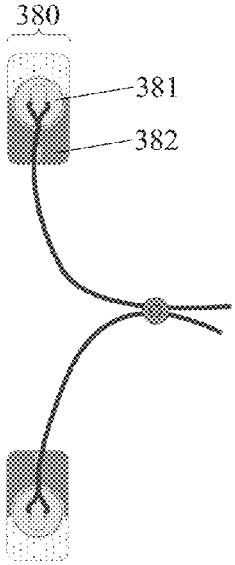

Referring now to FIG. 44*c*, the cooler 1 may have a double drawstring attachment 380 of varying size that allows medium to large size objects to be quickly secured to the cooler 1. The construction details of the double drawstring attachment are similar to the single drawstring attachment 370 with one exception. The double drawstring attachment has two drawstring bases that can be positioned apart to secure objects at two vertical points on the cooler. The double drawstring base 382 also has its eyehole mounted on a swivel 381 that is able to rotate 360 degrees. This allows objects to become secured at virtually any angle on the cooler 1.

Figure 45A:
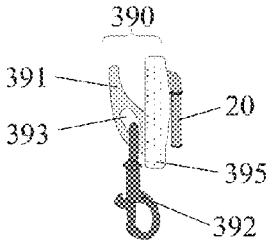
FIGS. 45*a-c* are a front view of a clasp attachment, a retractable clasp attachment, and a dual alligator clip attachment.

Referring now to FIG. 45*a*, the cooler 1 may have a clasp attachment 390 that allows a key ring or similarly shaped object to be hooked on or secured to a cooler 1. The construction details of the clasp attachment include a hook 391 with a small hole 393 midway down the hook on an attachment base 395 with a single snap prong 20 pointing in the direction opposite to the hook 391. A swivel eye spring clasp 392, herein referred to as a clasp, is connected to the hook hole 393.

Figure 45B:
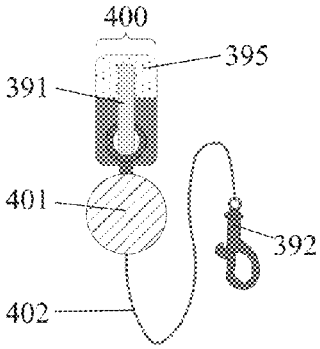

Referring now to FIG. 45*b*, the cooler 1 may have a retractable clasp attachment 400 which allows a key ring or similarly shaped object to be hooked on or secured to a cooler 1. The construction details of the retractable clasp attachment are almost identical to the clasp attachment 390, except that the clasp 392 is connected to the base 395 with a retractable cord 402 that coils into the retractable cord holder 401 when retracted.

Figure 45C:
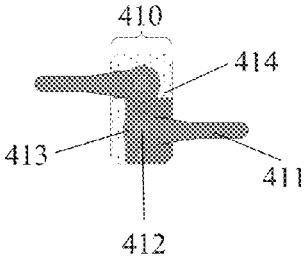
Figure 46A:
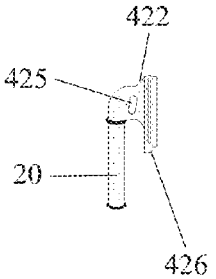
FIGS. 46*a-d* are a side view and rear view of a build-your-own prong and base attachment.
Figure 46B:
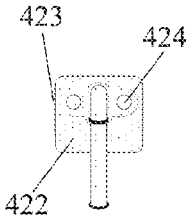
Figure 46C:
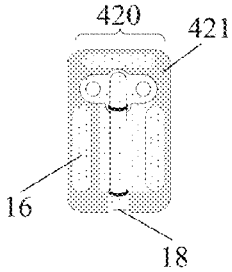
Figure 46D:
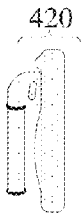

Referring now to FIG. 45*c*, the cooler 1 may have a dual alligator clip attachment 410 which is used to attach snack bags and similarly shaped objects to the cooler 1. The construction details of the clip attachment include two alligator clips 411 pointing in opposite directions attached to a clip base 414. The alligator clips are fastened to the base with a small post 412 through the clip handle 413. The clips are able to be rotated slightly more than 180 degrees around the posts. The back side of the clip base contains a single prong that points in a direction that is aligned up or down with the two alligator clip posts 412.

Referring now to FIGS. 46*a-d*, the cooler 1 may have components which enable the consumer to build their own attachable accessories. Core to the build-your-own attachments, herein referred to as BYO, is a combination of a BYO prong 422 and a BYO base 421. The top end of the BYO prong 422 is a thin block that is square in shape, which fits into a square recess in the front of the BYO base 421. The left, right, and top sides of the block have small ridges 423 that snap into the similarly shaped grooves in the BYO base. The bottom side of the block has a notch 426 that locks it into the base. The BYO prong has the same variations as defined in FIG. 7: a hook prong 22, a snug prong 21, and a snap prong 20. The BYO prong has a small slot 425 completely through the prong between the thin block and the 90 degree curve. The BYO prong also has two holes 424 through the thin block on either side of the prong.

Also referring to FIGS. 46*a-d*, the front side of the BYO base 421 is flat with the exception of the recess for the block 422 at the top end of the prong. The back side of the BYO base contains a raised protrusion (nub) 16 and a cleat guide 18 consistent with all the other attachments in the cooler. There is a large oval-shaped hole through the base for the prong located in the center of the block-shaped recess. To assemble a single prong BYO attachment 420, the BYO prong 422 is inserted prong first through the front of the BYO base 421 so that the notch 426 is positioned on its matching lip in the base and the ridges 423 on the sides of the block snap into their corresponding grooves.

Figure 47:
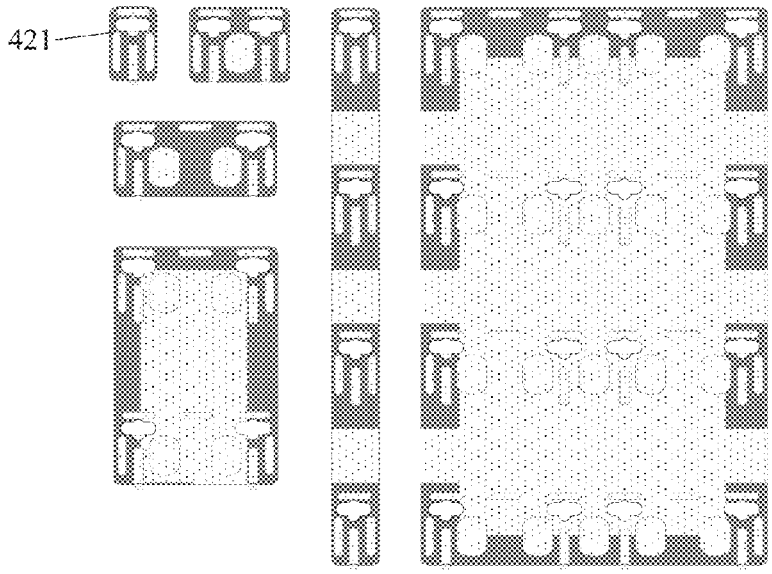
FIG. 47 is a rear view of build-your-own attachment bases of varying size.

Referring now to FIG. 47, the cooler 1 may have BYO bases of varying size. BYO bases may be ganged together to form a longer or wider base for the attachment. Large BYO bases require additional prongs.

Figure 48A:
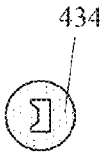
FIGS. 48*a-c* depict a build-your-own tie and button for the creation of user-fabricated attachments.
Figure 48B:
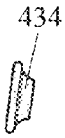
Figure 48C:
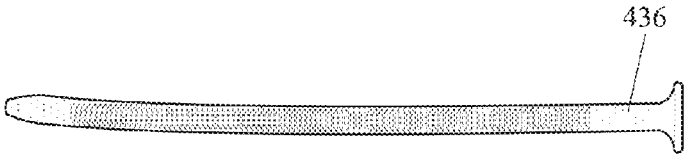

Referring now to FIGS. 48*a-c*, the cooler lmay have includes a BYO tie 436 which is used in conjunction with a BYO button 434 and a BYO prong 422. The consumer may use these three items to fabricate their own accessory. The BYO tie 436 is first inserted from the back of the prong through one of the two screw holes 424 in the prong. One end of the BYO tie 436 is large enough to prevent the tie from being pulled completely though the hole but small enough to become flush with the back of the prong when inserted. The BYO tie 436 is then wrapped around the object and inserted from the front of the prong through the second screw hole 424. One side of the BYO tie 436 contains a long row of serrations along its length similar to the ridges found on a common cable tie. After being inserted through the second screw hole 424, the BYO tie 436 is inserted through a BYO button 434. The BYO button 434 is circular in shape and has a rectangular hole in the middle large enough to allow the BYO tie 436 to pass through. The hole also contains a notch that is similar in size and shape to the serrations on the tie, but facing in the opposite direction. When the serrations on the BYO tie 436 pass over the notch they lock with each other in such a manner that prevents the tie from being pulled out of the BYO button 434. When the BYO tie 436 is drawn tight, the object being attached becomes firmly secured to the prong and its base. The final step of the assembly requires the consumer to trim the excess BYO tie 436 from the back of the prong so that its surface is flush with the BYO button 434.

Figure 49A:
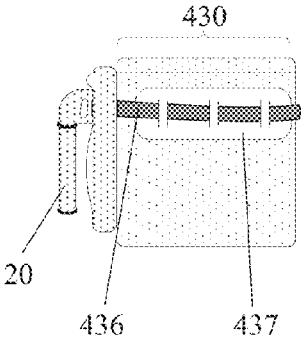
FIGS. 49*a-c* are side views of exemplary build-your-own attachment methods.
Figure 49B:
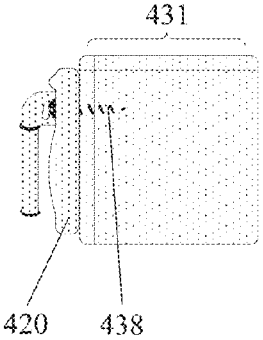
Figure 49C:
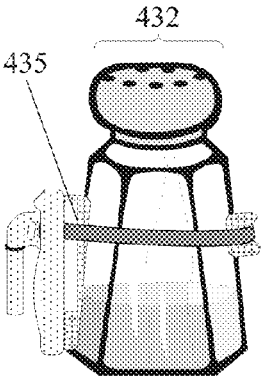

Referring now to FIGS. 49*a-c*, the cooler 1 may have varying methods of attaching consumer supplied accessories to a BYO attachment 420. The first example 430 in FIG. 49*a* shows a sample accessory secured to a BYO attachment 420 using a BYO tie 436, BYO button and a BYO tie shield 437. In this example the tie 436 may be fed through the prong 20 and base and threaded through the loops on one or more pieces of shield 437. BYO shields 437 may be cut by the consumer to the desired length. The shields spread the force exerted by the tie across a larger surface area. This reduces the risk of the tie pinching into soft-sided accessories and also increases the amount of friction between the tie and hard-sided accessories. After being threaded through the shields, the end of the tie is then fed through its BYO button, drawn tight, and trimmed leaving the accessory firmly attached to the BYO attachment.

Referring to FIG. 49*a-c*, the second example 431 shows a sample accessory secured to a BYO attachment 420 using consumer supplied screws 438. The third example 432 shows a sample accessory secured to a BYO attachment using the combination of a BYO tie, BYO button 434, and BYO pads 435. The BYO pads are made of firm sponge-like material that has a light coat of adhesive on one side. The BYO pads may be cut into the desired shape by the consumer. The BYO pads allow oddly shaped accessories to be secured with a tie to a BYO base.

Referring to now FIG. 46, FIG. 47, FIG. 48, and FIG. 49, the BYO components are intended to be supplied to the consumer in the form a kit. The configurable BYO kit would include one or more of the following components (1) the desired BYO prong types 20, 21, or 22; (2) the desired size of BYO attachment bases 421; (3) an assortment BYO ties 436 of varying length and BYO buttons 434; (4) a number of BYO shields 437; (5) a number of BYO pads 435; and (6) a number of BYO cords, which are not shown in the figures. The BYO cords allow accessories too large for a BYO tie to be secured to a BYO base. The BYO components enable the consumer to fabricate their own attachable accessories in a nearly unlimited number of ways.

Figure 50A:
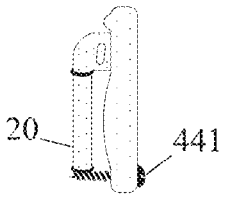
FIGS. 50*a-b* are a side views and an installed view of the build-your-own fixed mount feature.
Figure 50B:
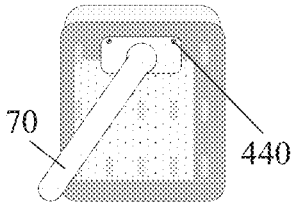

Referring now to FIG. 50, the cooler 1 may have a means by which attachments can be permanently secured to a cooler 1. The BYO fixed mount feature is simply a set of screws and instructions on where to install them so that the accessory cannot be knocked off or be easily removed. Most attachments specified in this cooler have a BYO fixed mount mark 440 embossed on their surface that denotes the proper location to install a screw. When installed, the screw 441 comes to rest just below the cleat with its tip penetrating and deforming the bottom part of the prong 20. The BYO fixed mount feature is counter to the design of the cooler, which allows for easy removal and reconfiguration of the accessories. However, there may be applications in rugged environments that require the cooler 1 to be transported with certain accessories always attached, such as adjustable feet on the ends of serving table legs or a tool holder. The BYO fix mount feature can also be used on attachments that attach upwards, such as the lunch pail handle attachment 70.

Figure 51:
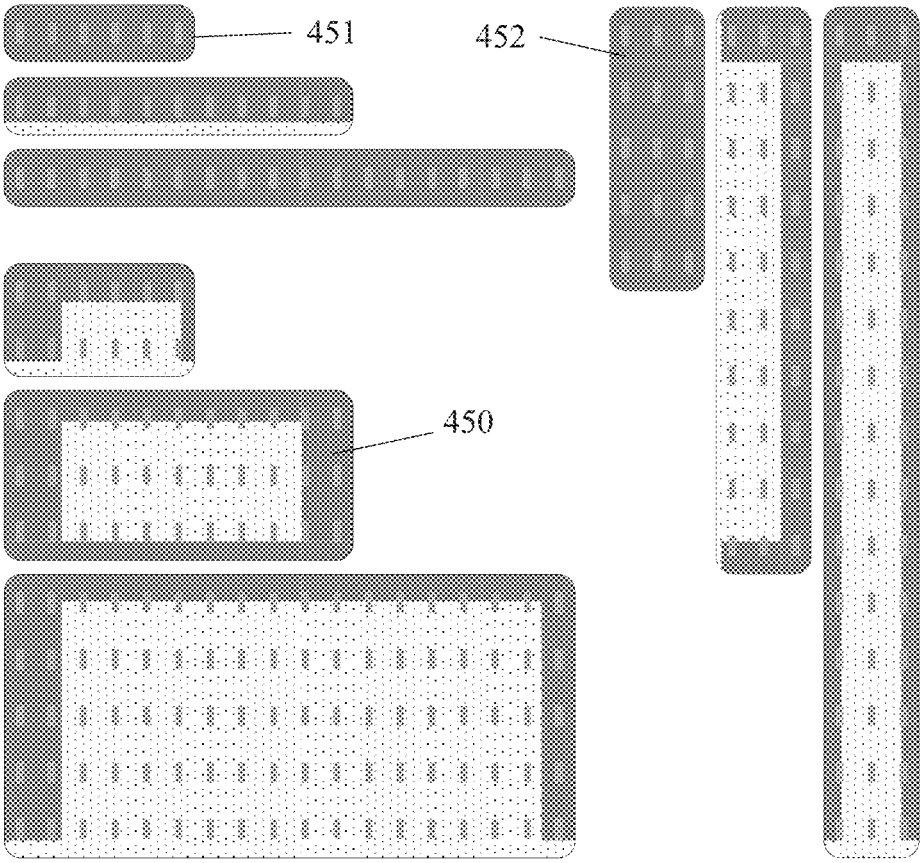
FIG. 51 is a front view of build-your-own cleat panels of varying size.

Referring now to FIG. 51, the cooler 1 may have BYO cleat panels 450 of varying size that allow the consumer to use their cooler accessories across a broad array of living, working, and recreational platforms. The cleats on the BYO cleat panels may be identical in size to the cleats on the cooler and are arranged in the same pattern. The panels can be mounted on a wall, boat, shed or other consumer objects with large flat surfaces. Panels can be ganged together to form larger panels. Panels do not contain holes or other mounting features (because the type and placement of the holes are dependent on the characteristics of the object to which they are attached). The present cooler also includes BYO cleat strips 451 and BYO cleat columns 452 of varying size, which are single row and column variations of the cleat panel 450.

Although embodiments of the present cooler are shown and described therein, it should be understood that various changes and modifications to the presently preferred embodiments will be apparent to those skilled in the art. Such changes and modifications may be made without departing from the spirit and scope of the present cooler and without diminishing its attendant advantages. It is, therefore, intended that such changes and modifications be covered by the appended claims.

The invention claimed is:

1. A cooler comprising:

a housing having a front wall, a back wall, a first side wall, a second side wall, a top wall, a bottom wall, and interior surface walls defining a generally hollow interior;

a plurality of elongated recessed openings wherein the plurality of elongated recessed openings have a first end and a second end and wherein the plurality of elongated recessed openings are located substantially within the walls of the housing;

wherein the plurality of elongated recessed openings are partially located in at least two of the front wall, the back wall, the first side wall, the second side wall, the top wall, the bottom wall or the interior surface walls of the generally hollow interior of the housing, a plurality of removable objects temporarily secured to the front wall, the back wall, the first side wall, the second side wall, the top wall, the bottom wall and/or the interior surface walls of the cooler wherein the plurality of removable objects are temporarily secured to an elongated prong wherein the elongated prong has a diameter and wherein the elongated prong is partially received in the plurality of elongated recessed openings of the housing;

wherein the diameter of the elongated prong is slightly less than the diameter of the elongated recessed opening of the housing;

a bushing located at a first end and/or a second end of the plurality of elongated recessed openings of the housing wherein the bushing has a diameter;

a main body of the elongated prong; and a first end and a second end of the elongated prongs wherein the elongated prongs are secured to a base support and wherein the first end and/or second end of the elongated prongs have a generally cylindrical ring having a diameter which is slightly greater than a diameter of the main body of the elongated prong and wherein the generally cylindrical ring is received by the bushing of the elongated recessed openings and wherein the bushing of the elongated recessed opening contacts the generally cylindrical ring of the elongated prongs and prevents the elongated prongs from accidentally moving with respect to the elongated recessed openings.

2. The cooler of claim 1 wherein the generally cylindrical rings are made of plastic, metal or rubber.

3. A cooler comprising:

a housing having a front wall, a back wall, a first side wall, a second side wall, a top wall, a bottom wall, and interior surface walls defining a generally hollow interior;

a plurality of elongated recessed openings wherein the plurality of elongated recessed openings have a first end and a second end and wherein the plurality of elongated recessed openings are located substantially within the walls of the housing;

wherein the plurality of elongated recessed openings are partially located in at least two of the front wall, the back wall, the first side wall, the second side wall, the top wall the bottom wall or the interior surface walls of the generally hollow interior of the housing;

a plurality of removable objects temporarily secured to the front wall, the back wall, the first side wall, the second side wall, the top wall, the bottom wall and/or the interior surface walls of the cooler wherein the plurality of removable objects are temporarily secured to an elongated prong wherein the elongated prong has a diameter and wherein the elongated prong is partially received in the plurality of elongated recessed openings of the housing;

wherein the diameter of the elongated prong is slightly less than the diameter of the elongated recessed opening of the housing; and a base support for the elongated prong wherein the base support has a top, a bottom, a front, a back, a first side and a second side wherein the base support for the elongated prongs have an adjustable securing strap connected to the first side and second side of the base support wherein the adjustable securing strap secures a removable object of variously shapes to the front of the base support for the removable objects and wherein the elongated prong of the base support for the removable objects secures the removable objects to the cooler.

4. The cooler of claim 3 wherein the various objects secured to the front of the base support for the elongated prong include at least a cup holder, a paper towel rack, a garbage bag holder, removable handle, removable latch, removable legs, removable pouch, a salt and pepper shaker, a lamp, a water-tight sealed container, or a removable tray.

5. The cooler of claim 3 wherein the adjustable securing strap is elastic.

6. The cooler of claim 3 wherein the adjustable securing strap wraps around a perimeter of the various object and substantially covers the perimeter of the object.

7. The cooler of claim 3 wherein the base support has a notch wherein the notch of the base support is received by an opening having similar dimensions wherein the opening having similar dimensions is located on the front wall, the back wall, the top wall, the bottom wall, the first side wall or the second side wall of the cooler and wherein the removable objects are prevented from moving when the notch of the base support is located within the opening having similar dimensions of the cooler.

8. The cooler of claim 3 further comprising:

a protrusion located on the back of the base support wherein the protrusion of the base support contacts a surface of the cooler and wherein the pressure of the protrusion wedged between the back of the base support and the surface of the cooler secures the base support and therein the removable objects to the cooler.

9. The cooler of claim 3 wherein the base of the removable object has an opening for receiving a screw having a tip and wherein the tip of the screw penetrates and deforms a portion of the prong and therein permanently secures the prong and the removable object to the cooler.

10. The cooler of claim 3 wherein the base support for the removable objects are identical in size.

11. A cooler comprising:

a housing having a front wall, a back wall, a first side wall, a second side wall, a top wall, a bottom wall, and interior surface walls defining a generally hollow interior;

a plurality of both vertically and horizontally elongated recessed openings forming a matrix wherein the plurality of vertically and horizontally elongated recessed openings have a first end and a second end and wherein the plurality of vertically and horizontally elongated recessed openings are located substantially within the walls of the housing;

wherein the plurality of vertically and horizontally elongated recessed openings are partially located in at least two of the front wall, the back wall, the first side wall, the second side wall, the top wall, the bottom wall or the interior surface walls of the generally hollow interior of the housing;

a plurality of removable objects temporarily secured to the front wall, the back wall, the first side wall, the second side wall, the top wall, the bottom wall and/or the interior surface walls of the cooler wherein the plurality of removable objects are temporarily secured to an elongated prong wherein the elongated prong has a diameter and wherein the elongated prong is partially received in the plurality of vertically and horizontally elongated recessed openings of the housing; and wherein the diameter of the elongated prong is slightly less than the diameter the elongated vertically and horizontally recessed opening of the housing.

12. The cooler of claim 11 further comprising:

a movable divider partition forming a wall wherein the movable divider partition has a permanently secured prong and wherein the permanently secured prong of the movable divider partition is temporarily inserted into an elongated recessed opening on an interior surface of the interior of the cooler and wherein the movable divider partition allows a user to divide the interior of the cooler into various multiple sections.

13. The cooler of claim 12 wherein the movable divider partition has a permanently secured prong which is secured within the elongated recessed openings of the cooler wherein the movable divider partition may be secured in a non-perpendicular orientation with respect to the front wall, the back wall, the first side wall or the second side wall of the cooler.

14. The cooler of claim 12 wherein a removable tray having a prong is inserted into an elongated opening of the interior of the cooler.

15. The cooler of claim 11 further comprising:

a removable net having prongs wherein the removable net is selectively secured to the exterior surface of the cooler when a prong of the removable net is inserted into an elongated recessed opening of an exterior surface of the cooler.

16. The cooler of claim 11 further comprising:

a removable wheel attachment wherein the removable wheel attachment has a top and a bottom and wherein the top of the removable wheel attachment is secured to the bottom wall or the side wall of the cooler and wherein the removable wheel attachment allows the cooler to be pushed or pulled and wherein the removable wheel attachment has a prong which is temporarily secured within the elongated recessed opening of the cooler.

* * * * *